US010317153B2

(12) United States Patent
Faifer

(10) Patent No.: US 10,317,153 B2
(45) Date of Patent: Jun. 11, 2019

(54) APPARATUS AND METHOD FOR INCREASING CAPACITY OF AN AMMUNITION MAGAZINE

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 15/647,248

(22) Filed: Jul. 11, 2017

(65) Prior Publication Data

US 2018/0031342 A1 Feb. 1, 2018

Related U.S. Application Data

(60) Provisional application No. 62/360,583, filed on Jul. 11, 2016.

(51) Int. Cl.
*F41A 9/71* (2006.01)
*F41A 9/70* (2006.01)

(52) U.S. Cl.
CPC . *F41A 9/71* (2013.01); *F41A 9/70* (2013.01)

(58) Field of Classification Search
CPC ..... F41A 9/70; F41A 9/71
USPC ..... 42/49.02, 50
See application file for complete search history.

(56) References Cited

U.S. PATENT DOCUMENTS

| | | | |
|---|---|---|---|
| 254,453 | A | 3/1882 | Borchardt |
| 283,122 | A | 8/1883 | Lewis |
| 303,992 | A | 8/1884 | Diss |
| 313,851 | A | 3/1885 | Cook |
| 431,410 | A | 7/1890 | Speed |
| 999,387 | A | 8/1911 | Mauser |
| 1,129,884 | A | 3/1915 | Mauser |
| 2,434,269 | A | 3/1945 | Harvey |
| 2,507,364 | A | 8/1947 | Benson |
| 2,715,789 | A | 8/1955 | Garand |
| 2,795,880 | A | 6/1957 | Patchett |
| 2,903,809 | A | 9/1959 | Stoner |
| 3,191,332 | A | 6/1965 | Ardolino |
| 3,399,480 | A | 9/1968 | Rowe, Jr. |
| 3,619,929 | A | 11/1971 | Fremont |
| 3,732,643 | A | 5/1973 | Wells |
| 3,736,686 | A | 6/1973 | Moller et al. |
| D244,285 | S | 5/1977 | Sofinowski |

(Continued)

FOREIGN PATENT DOCUMENTS

CA 2793964 * 1/2012

*Primary Examiner* — Stephen Johnson
(74) *Attorney, Agent, or Firm* — Law Office of Arthur M. Antonelli, PLLC

(57) ABSTRACT

A magazine extension may include a body for storing firearm ammunition. The body may include an upper end portion which includes a seat for part of a firearm. The upper end portion further may include a magazine casing receiving groove. Also, the body may include a lower end portion, and an exterior surface extending from the upper end portion to the lower end portion, as well as an opening extending into the body. The body may include a bench inside the opening. A magazine extension follower may be disposed above the bench. The magazine extension follower may include an upper surface, a lower surface, and a side wall. The magazine extension follower may form an ammunition magazine spring bearing surface. The magazine extension may include a resilient member disposed between the magazine extension follower and the bench which biases the magazine extension follower away from the lower end.

20 Claims, 20 Drawing Sheets

(56) References Cited

U.S. PATENT DOCUMENTS 4,107,862 A 8/1978 Sofinowski, III
4,115,943 A 9/1978 Musgrave
4,127,954 A 12/1978 Hausmann
4,128,042 A 12/1978 Atchisson
4,139,959 A 2/1979 Howard et al.
4,391,055 A 7/1983 Kadim
4,408,409 A 10/1983 Arias
4,413,437 A 11/1983 Anderson
4,428,137 A 1/1984 Johnson
4,586,281 A 5/1986 Chesnut
4,587,756 A 5/1986 Jakubaschk et al.
4,589,218 A 5/1986 Teppa
4,831,761 A 5/1989 Kulakow
5,014,456 A 5/1991 Kurtz et al.
5,099,595 A 3/1992 Chestnut et al.
5,113,605 A * 5/1992 Kim ..... F41A 9/71 42/50
5,149,897 A 9/1992 Howard
5,153,359 A 10/1992 Lishness
5,206,444 A 4/1993 Oliver
5,279,059 A 1/1994 Howard
5,287,720 A 2/1994 Lishness
5,291,679 A 3/1994 Wollack et al.
5,309,660 A 5/1994 Blackamore
5,329,718 A 7/1994 Howard
5,345,660 A 9/1994 Howard
5,386,657 A 2/1995 Racheli
5,388,360 A 2/1995 Fortunato
5,438,783 A 8/1995 Sniezak et al.
5,461,811 A 10/1995 Ciener
5,507,110 A 4/1996 Chesnut et al.
5,526,600 A 6/1996 Chesnut et al.
5,561,933 A 10/1996 Czekalski
5,568,696 A * 10/1996 Mauch ..... F41A 9/71 42/49.02
5,588,241 A 12/1996 Hurley
5,615,505 A 4/1997 Vaid
5,638,626 A 6/1997 Westrom
5,642,581 A 6/1997 Herold et al.
5,697,179 A 12/1997 Vanmoor
5,755,052 A 5/1998 Keeney
5,761,841 A 6/1998 Snick
5,956,878 A 9/1999 Yang
6,606,811 B1 8/2003 Olson
6,739,082 B2 5/2004 Christensen
6,748,689 B2 6/2004 Fitzpatrick
6,829,855 B2 12/2004 Seifert
6,883,261 B2 4/2005 Fitzpatrick
7,200,964 B2 4/2007 Gates
7,237,354 B1 4/2007 Conner
7,261,029 B1 8/2007 Davis
7,318,294 B2 1/2008 Zimmermann
7,398,615 B2 7/2008 Wheatley
7,441,491 B2 10/2008 Snow
7,509,767 B2 3/2009 Bolen
7,533,483 B1 5/2009 Alzamora et al.
7,536,816 B2 5/2009 Weinberger
7,621,063 B2 11/2009 Fitzpatrick et al.
7,698,844 B2 4/2010 Gruber et al.
7,765,997 B2 6/2010 Klockener et al.
7,908,780 B2 3/2011 Fitzpatrick et al.
7,937,872 B1 5/2011 Fluhr
7,958,660 B2 6/2011 Fitzpatrick et al.
7,975,420 B2 7/2011 Pestana
8,006,423 B1 8/2011 Alzamora et al.
8,021,208 B2 9/2011 Victor
8,042,297 B2 10/2011 Emde
8,061,071 B2 11/2011 Fitzpatrick et al.
8,069,601 B1 12/2011 Fitzpatrick et al.
8,166,692 B2 5/2012 Fitzpatrick et al.
8,191,297 B2 6/2012 Gwillim, Jr.
8,196,327 B2 6/2012 Rich
8,225,541 B2 7/2012 Bigley et al.
8,347,774 B2 1/2013 Rich
8,356,439 B2 1/2013 Dubois
8,356,440 B2 1/2013 Troy
8,407,922 B1 4/2013 Taylor
8,434,254 B1 5/2013 Watchorn et al.
8,448,364 B2 5/2013 Davidson
8,468,730 B2 6/2013 Faifer et al.
8,484,875 B2 7/2013 Heath
8,572,877 B2 11/2013 Sullivan
8,590,202 B2 11/2013 Keng
8,590,203 B1 11/2013 McCarthy et al.
8,607,489 B1 12/2013 Calvert
8,635,796 B2 1/2014 Fitzpatrick et al.
8,650,787 B2 2/2014 McCormick
8,667,724 B2 3/2014 Zheng
8,839,543 B2 9/2014 Fitzpatrick et al.
D718,406 S 11/2014 Mayberry et al.
D718,834 S 12/2014 Mayberry et al.
D720,422 S 12/2014 Fitzpatrick et al.
8,966,801 B1 3/2015 Bentley
8,991,086 B2 3/2015 Fitzpatrick et al.
D736,337 S 8/2015 Kielsmeier et al.
D745,944 S 12/2015 Keilsmeier et al.
D745,945 S 12/2015 Keilsmeier et al.
D746,403 S 12/2015 Keilsmeier et al.
9,222,739 B1 12/2015 Bennett et al.
D748,219 S 1/2016 Keilsmeier et al.
9,255,749 B2 2/2016 Faifer
D755,336 S 5/2016 Nakayama et al.
D757,884 S 5/2016 Keilsmeier et al.
9,347,720 B2 5/2016 Fitzpatrick et al.
9,383,152 B2 7/2016 Nakayama et al.
9,389,036 B2 7/2016 Fitzpatrick et al.
9,429,378 B2 8/2016 Bennett et al.
D765,812 S 9/2016 Keilsmeier et al.
D765,813 S 9/2016 Roberts et al.
9,470,464 B2 10/2016 Kielsmeier et al.
9,506,707 B2 11/2016 Nakayama et al.
9,528,784 B2 12/2016 Roberts et al.
9,612,069 B2 4/2017 Bennett et al.
9,702,645 B2 7/2017 Nakayama et al.
9,976,825 B2 5/2018 Faifer
2017/0097202 A1* 4/2017 Fitzpatrick ..... F41A 9/70
2018/0031342 A1 2/2018 Faifer

* cited by examiner

APPARATUS AND METHOD FOR INCREASING CAPACITY OF AN AMMUNITION MAGAZINE

CROSS REFERENCE TO RELATED APPLICATIONS

This application claims the benefit of U.S. Provisional Application No. 62/360,583 filed on Jul. 11, 2016. U.S. Provisional Application No. 62/360,583 is incorporated by reference herein in its entirety.

FIELD OF THE INVENTION

The invention generally relates to a magazine extension for a firearm. More particularly, the invention relates to a magazine extension for a pistol.

BACKGROUND

Magazine extensions for pistol magazines are known in the related art. These units may replace a magazine base plate to add an additional gripping surface. The additional gripping surface may enhance user comfort and control. The magazine extension further may increase the ammunition capacity of the magazine. These units may require permanent modification of the magazine or replacement of magazine components, such as the magazine spring. These changes, however, may adversely affect the reliability of the magazine and increase the risk of malfunction during operation of the firearm.

SUMMARY

Hence, the present disclosure is directed toward a magazine extension that may increase the ammunition capacity of a firearm ammunition magazine. For instance, a magazine extension may be configured for an ammunition magazine that includes a housing with a rim. The magazine extension may include a body for storing firearm ammunition. The body may include an upper end portion. The upper end portion may include a seat configured to receive a portion of a firearm, a magazine casing bearing surface spaced from the seat, the magazine casing bearing surface being substantially flat. The upper end portion further may include a magazine casing receiving groove proximate the magazine casing bearing surface, the magazine casing receiving groove and the magazine casing bearing surface being configured and dimensioned to slidably receive a rim of an ammunition magazine housing. The body may further include a lower end portion spaced from the upper end portion, an exterior surface extending from the upper end portion to the lower end portion, and an opening extending into the body from the upper end portion toward the lower end portion. Also, the body may include a bench inside the opening disposed between the upper end portion and the lower end portion such that the opening terminates at the bench. The magazine extension further may include a magazine extension follower disposed above the bench. The magazine extension follower may include an upper surface, a lower surface, and a side wall around the upper surface. The side wall and the upper surface may form a cup that is configured and dimensioned to form an ammunition magazine spring bearing surface. The magazine extension further may include a resilient member disposed in the opening proximate to the lower surface of the magazine extension follower and the bench such that the resilient member biases the magazine extension follower away from the lower end.

The resilient member may include at least one spring. The at least one spring may be two springs. The two springs may be substantially the same. The two springs may be coil springs. The two springs may be disposed adjacent to one another. The at least one spring may be a flat spring. The flat spring may be a spiral compression spring. The at least one spring may be designed to provide a minimum level of spring force against the magazine extension follower when the magazine extension follower is positioned within the opening. The minimum level of spring force may be based on a measure of compressive force needed to depress a sole remaining ammunition cartridge stored in an ammunition magazine. The minimum level of spring force may be based on an average of a series of measurements of compressive force needed to depress a sole remaining ammunition cartridge stored in an ammunition magazine. The minimum level of spring force may be substantially equal to an average of a series of measurements of compressive force needed to depress a sole remaining ammunition cartridge stored in an ammunition magazine.

Moreover, the body may be separable into pieces. The body may be separable into a starboard side piece and a port side piece. The port side piece may include a hook, and the starboard side piece may include a hook receiving slot, the hook and the hook receiving slot may be configured and dimensioned to interlock. The bench may be part of the port side piece. Additionally, the exterior surface may be configured and dimensioned to complement a pistol grip.

An ammunition magazine assembly may include a magazine extension as disclosed herein, an ammunition magazine housing which comprises a rim, the rim being disposed in the magazine casing receiving groove; an ammunition magazine follower in the ammunition magazine housing; and a magazine spring disposed between the follower and the upper surface of the magazine extension follower.

A method of increasing the capacity of an ammunition magazine may include providing an ammunition magazine which comprises an ammunition magazine housing which comprises a rim, an ammunition magazine follower, and an ammunition magazine spring; providing a magazine extension as described herein; inserting the ammunition spring into the cup of the magazine extension follower; and inserting the rim into the magazine casing receiving groove.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
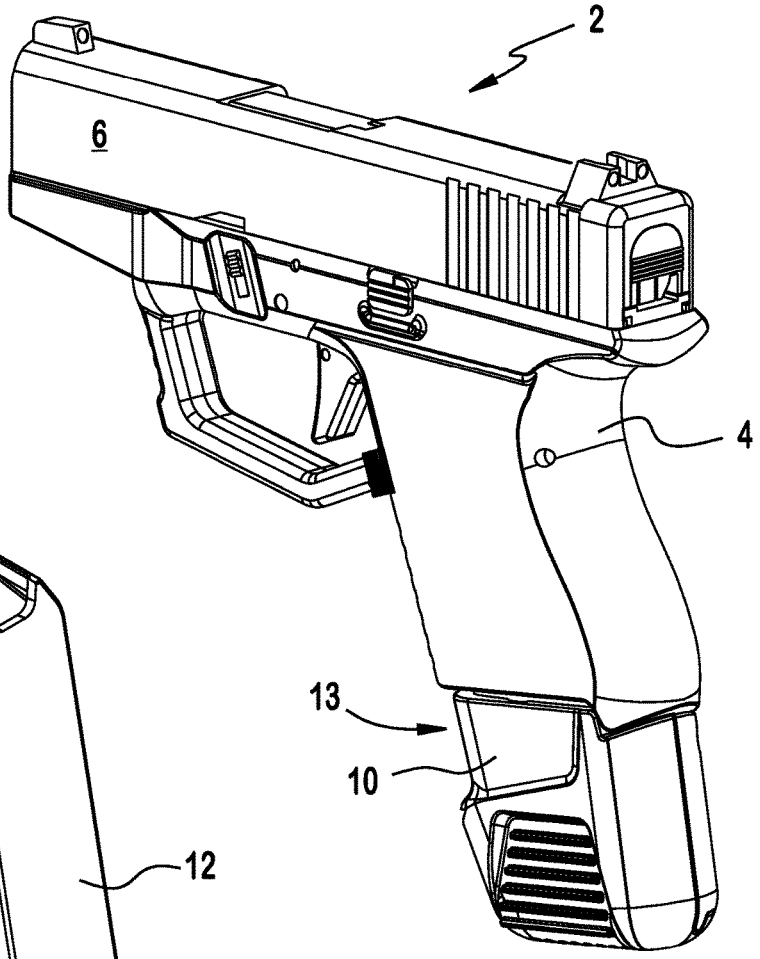
FIG. 1 is a perspective view of an illustrative firearm with an exemplary embodiment of an ammunition magazine assembly installed therein, the exemplary ammunition magazine assembly including an eight-round capacity ammunition magazine and a two-round capacity magazine extension.

FIG. 1 shows an illustrative pistol 2 which includes a slide 4 and a frame 6, along with an exemplary embodiment of an ammunition magazine assembly 8 installed therein.

Figure 2:
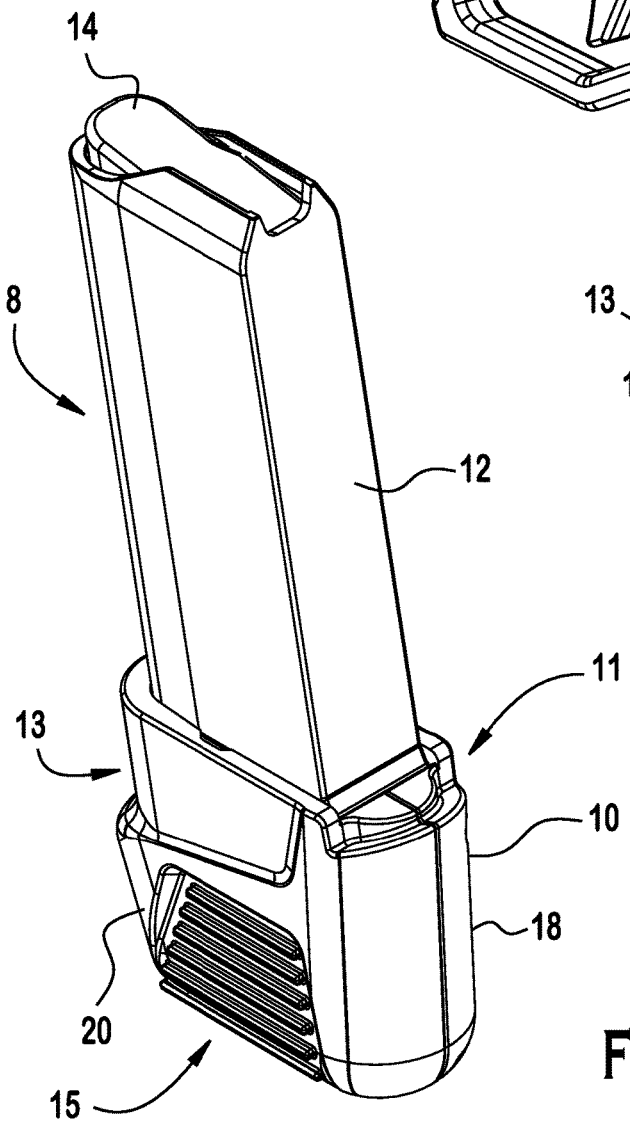
FIG. 2 is an upper, rear perspective view of the ammunition magazine assembly of FIG. 1 in an unloaded configuration.
Figure 4:
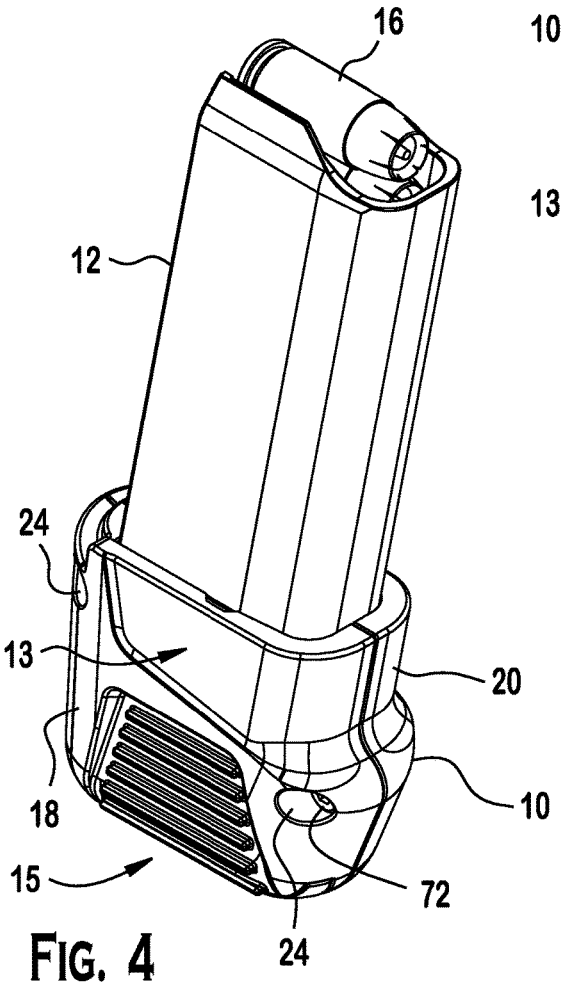
FIG. 4 is an upper, front perspective view of the ammunition magazine assembly of FIG. 3.
Figure 3:
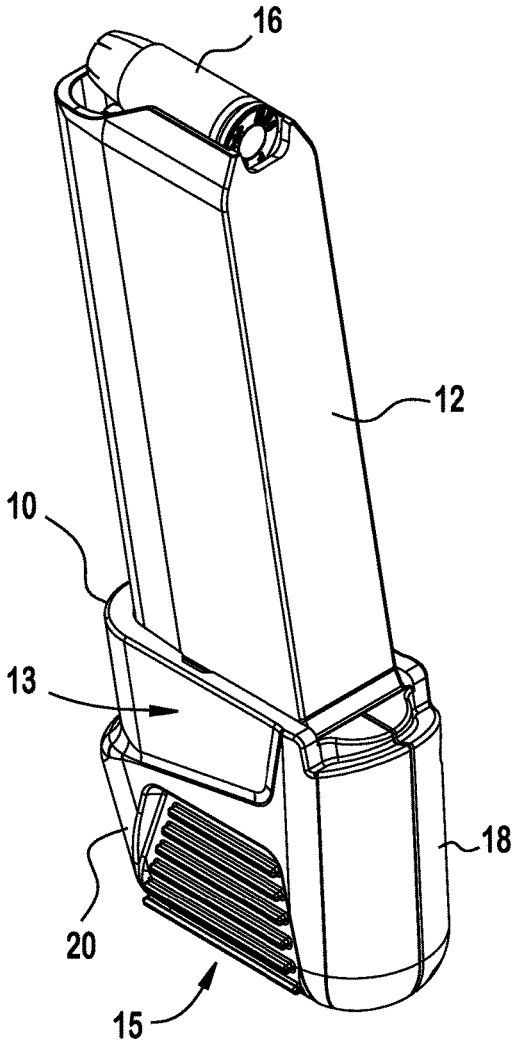
FIG. 3 is an upper, rear perspective view of the ammunition magazine assembly of FIG. 1 in a fully loaded configuration.
Figure 5:
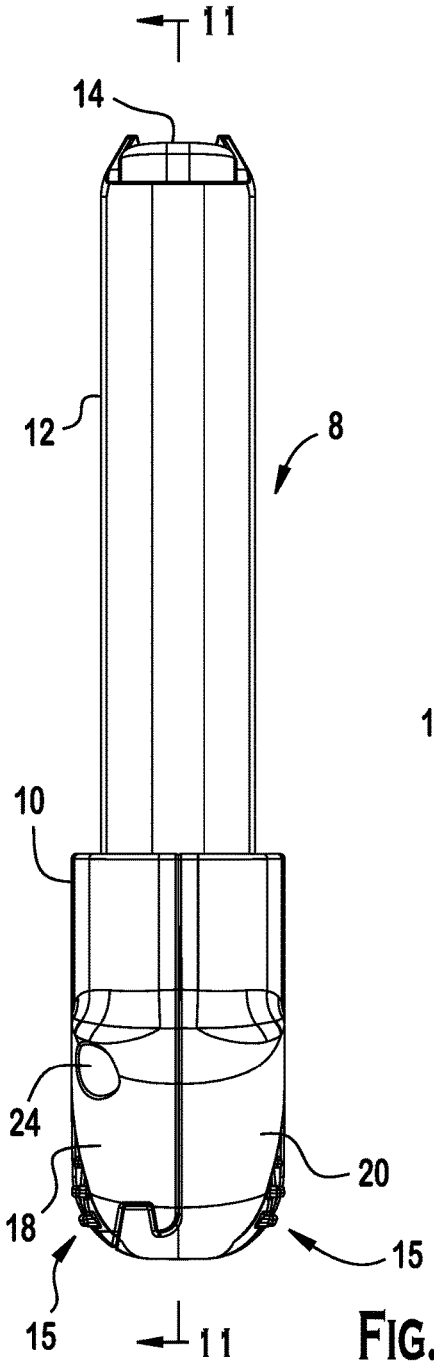
FIG. 5 is a front view of the ammunition magazine assembly of FIG. 2.
Figure 6:
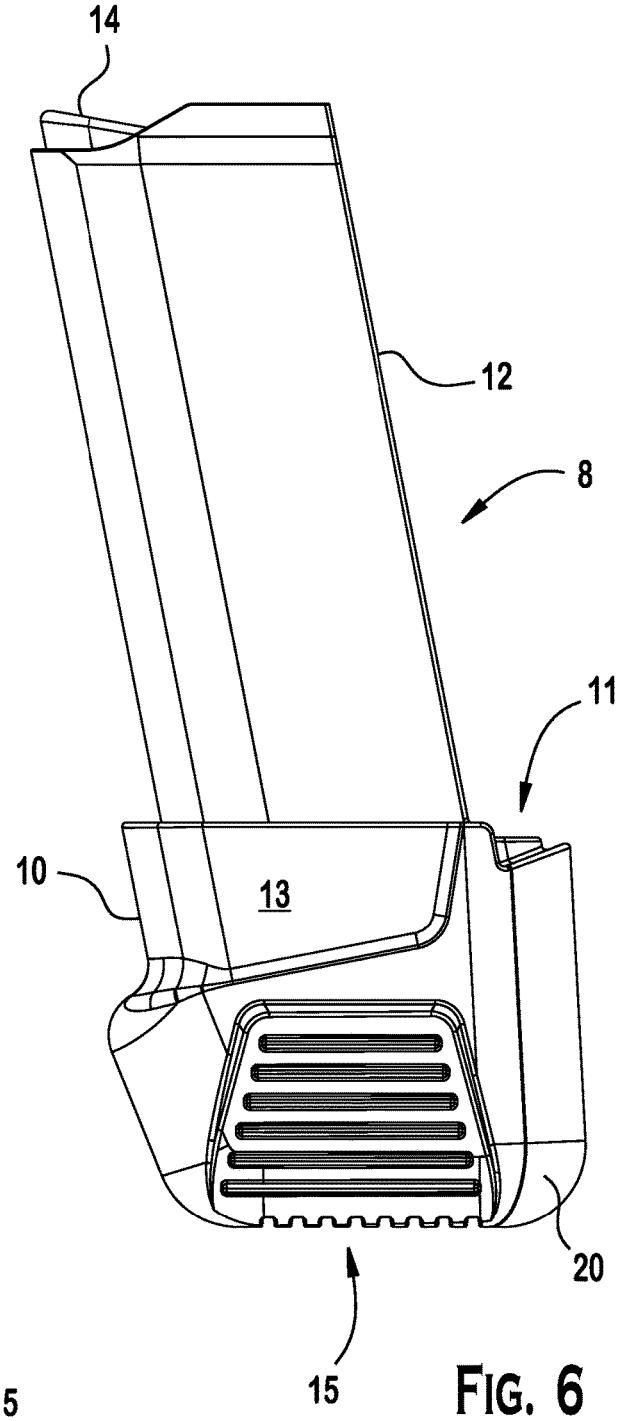
FIG. 6 is a right, side view of the ammunition magazine assembly of FIG. 2.

FIG. 2 shows a perspective view of an ammunition magazine assembly 8. The ammunition magazine assembly 8 may include a magazine extension 10 and a magazine housing 12. The magazine housing 12 may contain a magazine spring (not shown) and a follower 14. Although the magazine housing may be configured for an 8-round magazine, the magazine housing may be configured to store other quantities of ammunition cartridges. For example, without limitation, the magazine may be configured for a 6-round magazine, a 10-round magazine, a 12-round magazine, a 24-round magazine, or a 30-round magazine. As shown in FIGS. 3, 5, 7 and 9, the magazine assembly may include a port side piece 20 and a starboard side piece 18 which cooperate to form a magazine extension at the base of the magazine housing. Although the magazine housing 12 may be configured for 9 mm caliber cartridges 16 as depicted, the magazine housing may be configured for any type of ammunition cartridge (e.g., .22 caliber, .40 caliber, .45 caliber, .223 Remington, 5.56×45 mm Nato, or 7.62×39 mm) for which the receiving firearm may be chambered. Referring to FIGS. 1, 35, 36 and 37, the follower may be an original factory magazine part, and may include a magazine follower guide 48.

Figure 7:
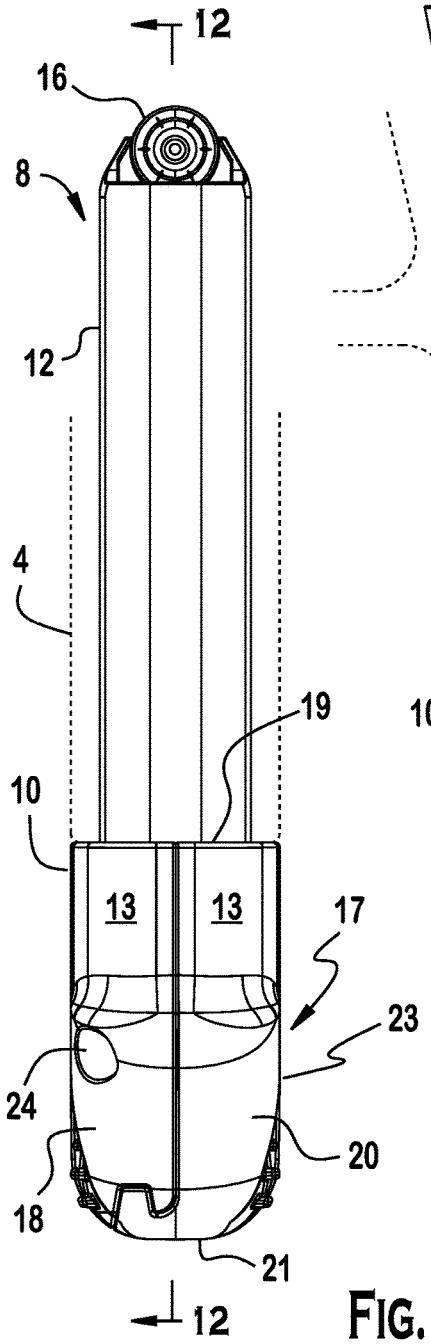
FIG. 7 is a front view of the ammunition magazine assembly of FIG. 3.
Figure 8:
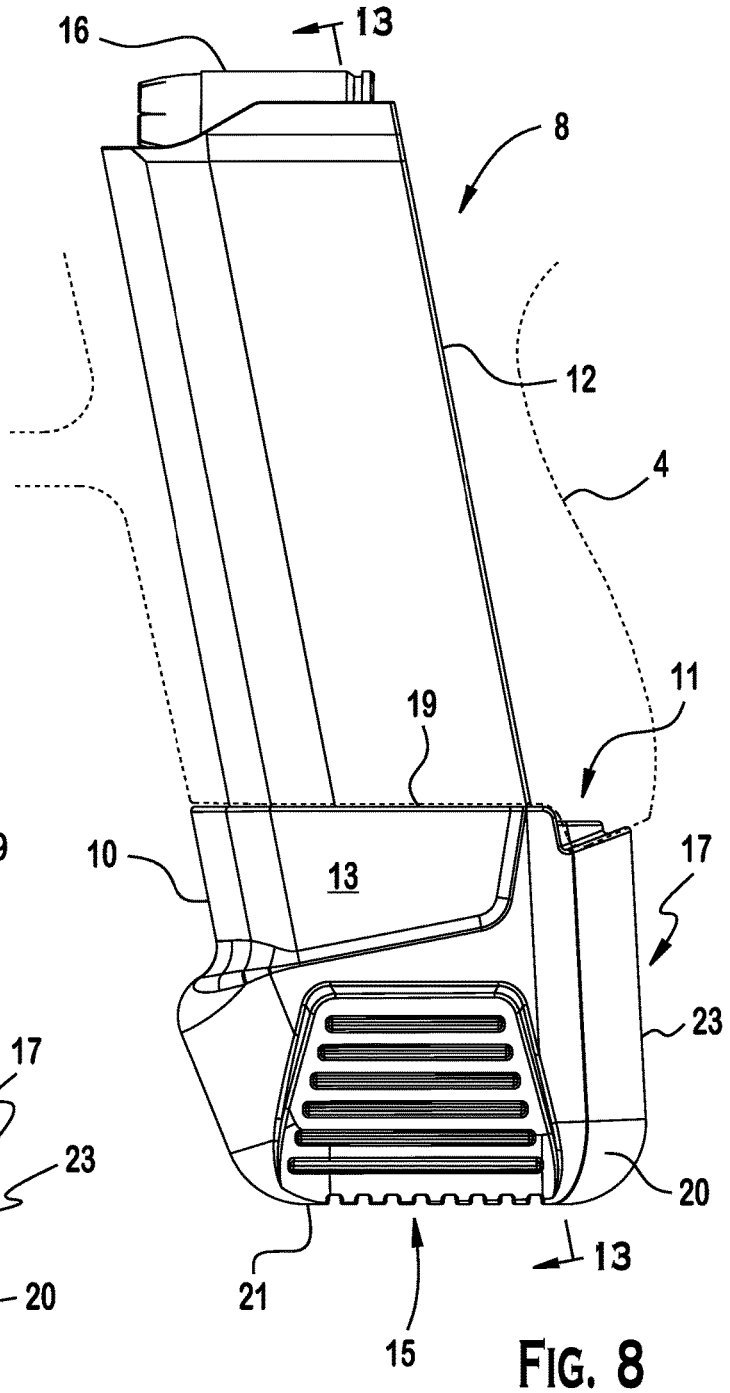
FIG. 8 is a right, side view of the ammunition magazine assembly of FIG. 3.
Figure 9:
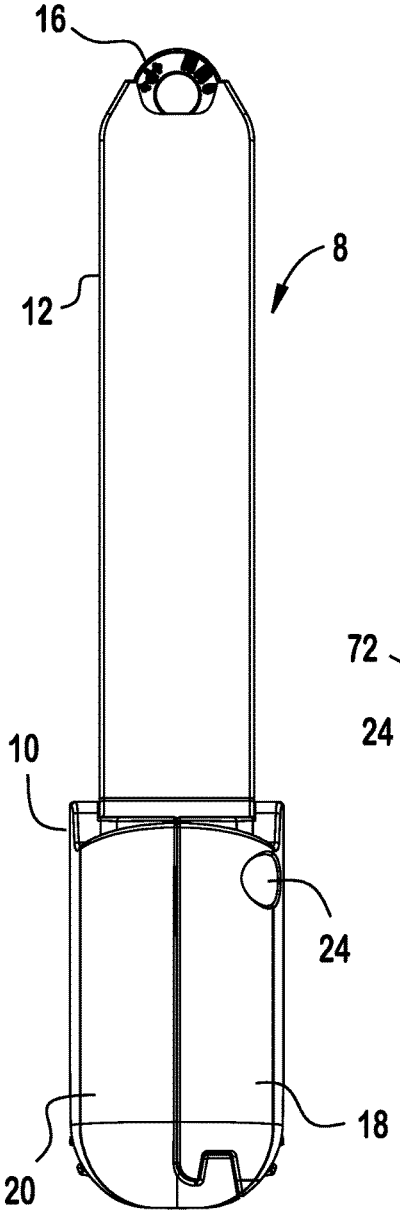
FIG. 9 is a rear view of the ammunition magazine assembly of FIG. 3.
Figure 10:
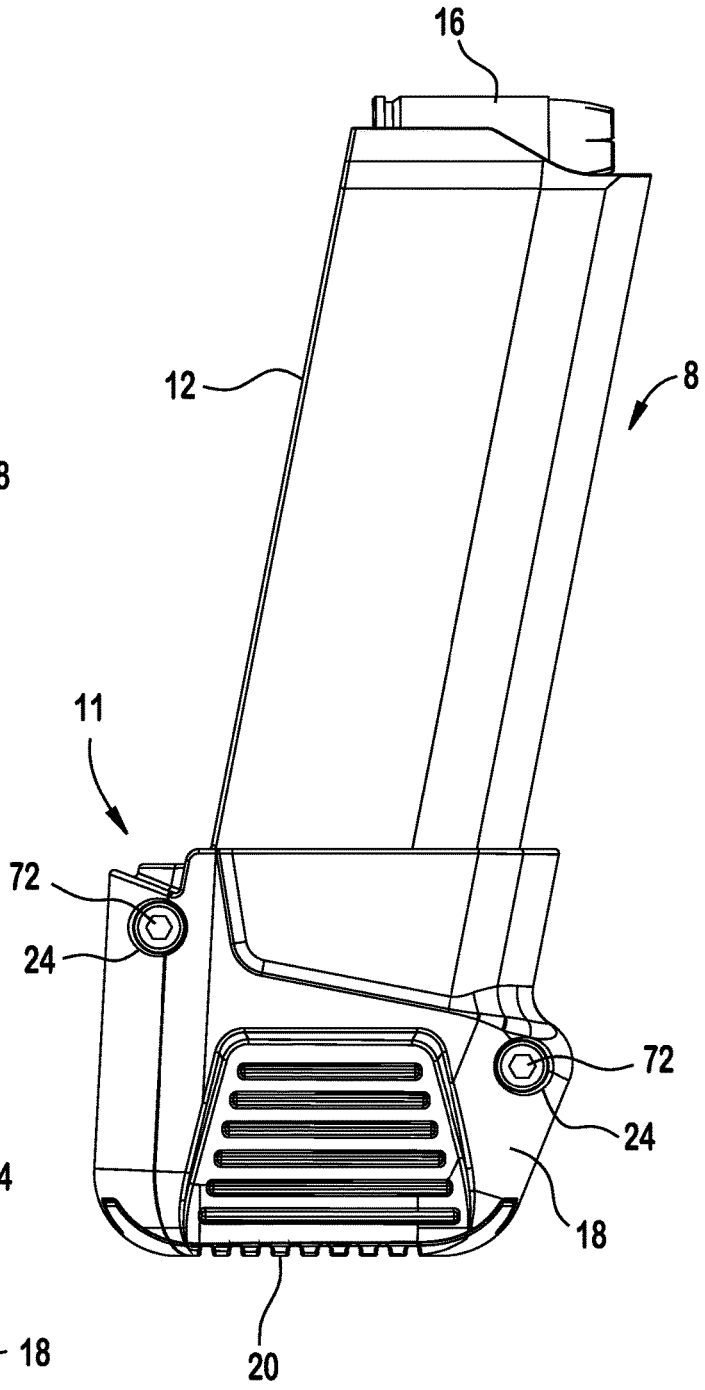
FIG. 10 is a left side view of the ammunition magazine assembly of FIG. 3.

Referring to FIGS. 1, 7, and 8, the magazine extension 10 may be shaped to mate with the grip of the pistol. For example, as shown in FIG. 2 and FIG. 8 the upper portion of the magazine extension may include a seat 11 that mates with the heel of the grip. The magazine extension further may include a recessed region 13 adjacent the pistol grip that is configured to extend the grip, and thereby form a fuller grip for a user of the pistol. The recessed region may be shaped to accommodate the ring and small finger of the user. Additionally, as shown in FIGS. 1-10, the lateral sides of the magazine extension may include a textured area 15 for enhancing the tactile grip of the ammunition magazine assembly 8 near its base. Although the textured area in the exemplary embodiment includes a series of parallel ridges, other structures and patterns may be used, as long as the structures promote the establishment of an enhanced substrate for gripping, holding, handling, or pulling the magazine extension.

Figure 11:
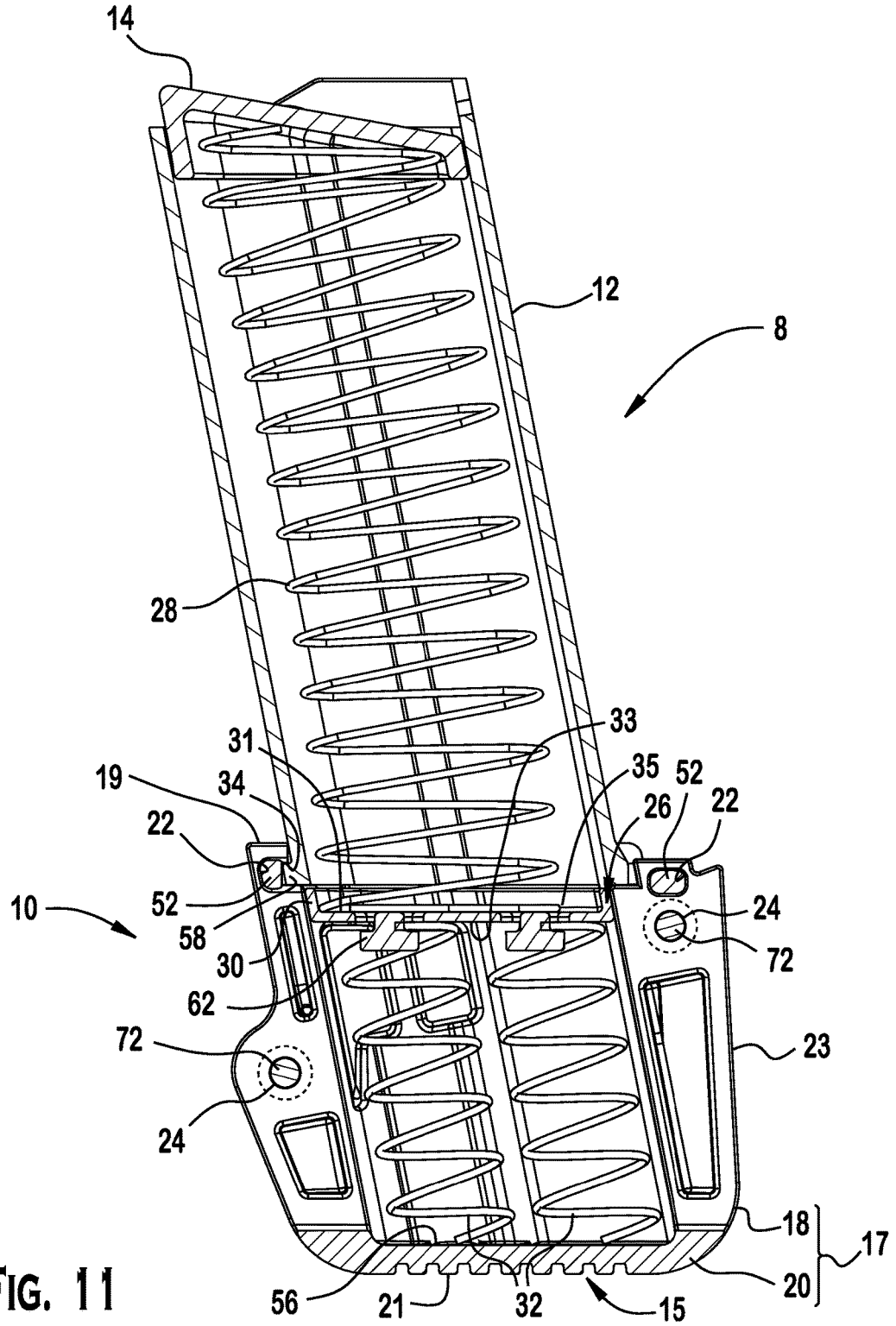
FIG. 11 is a cross-sectional view of the ammunition magazine assembly of FIG. 5, along line 11-11.
Figure 12:
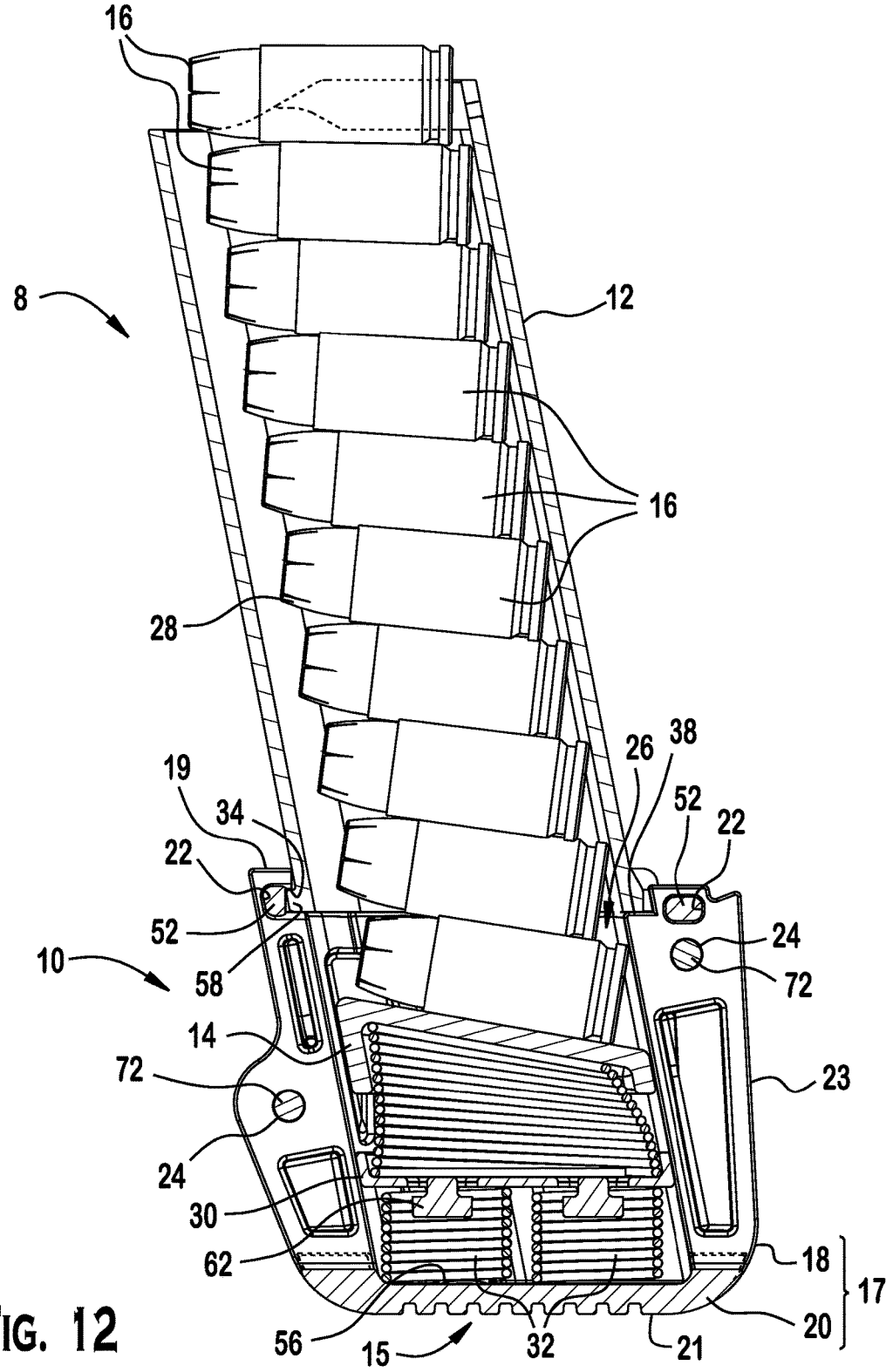
FIG. 12 is a cross-sectional view of the ammunition magazine assembly of FIG. 7, along line 12-12.
Figure 13:
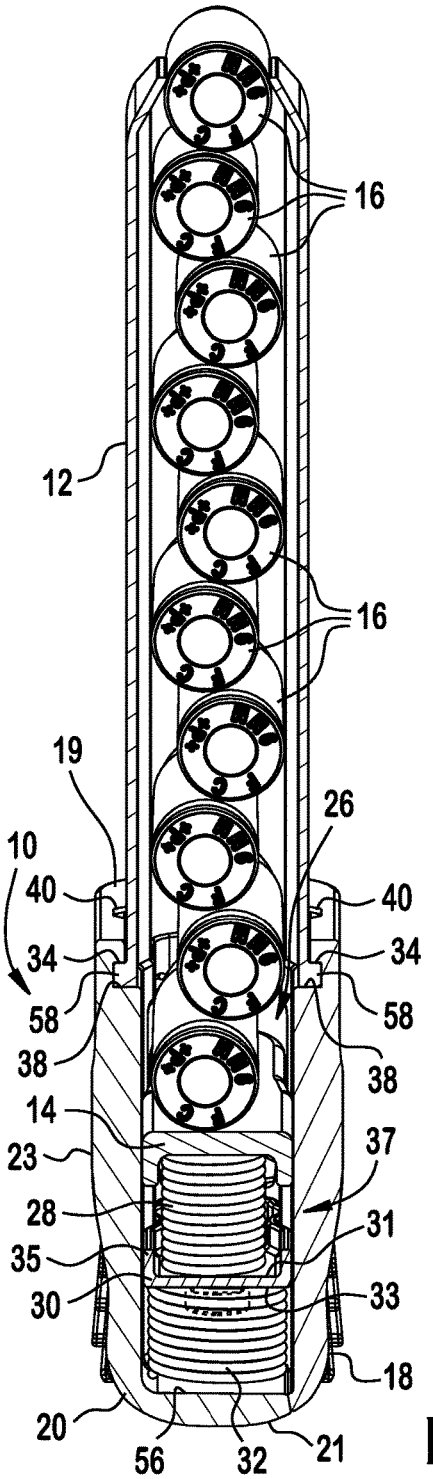
FIG. 13 is a cross-sectional view of the ammunition magazine assembly of FIG. 8, along line 13-13, the ammunition being depicted in dashed lines.
Figure 14:
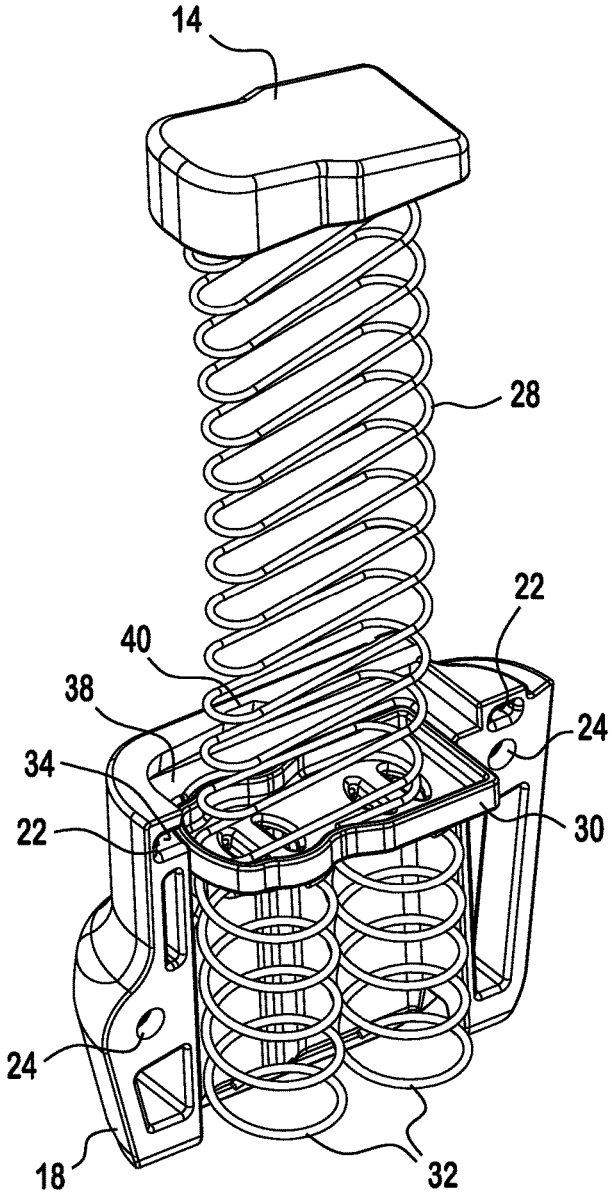
FIG. 14 is a perspective view of the ammunition magazine assembly of FIG. 2, without the magazine casing and the magazine extension port side piece.
Figure 15:
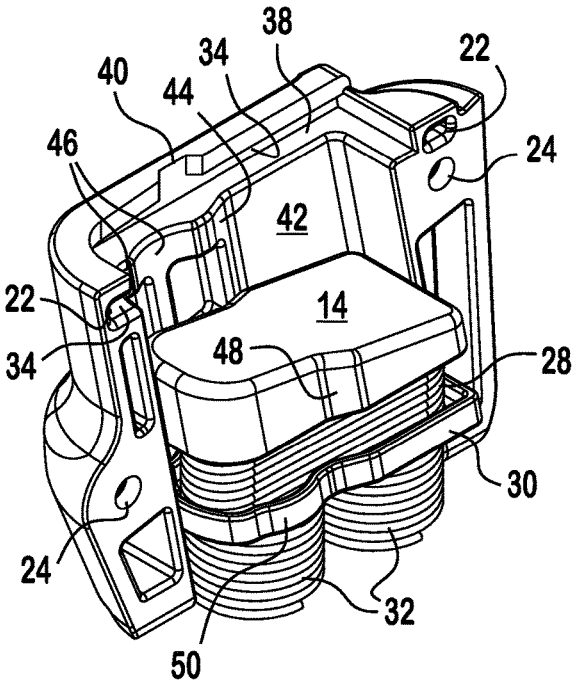
FIG. 15 is a perspective view of the ammunition magazine assembly of FIG. 14, showing the magazine spring and magazine extension springs in a fully compressed configuration.
Figure 16:
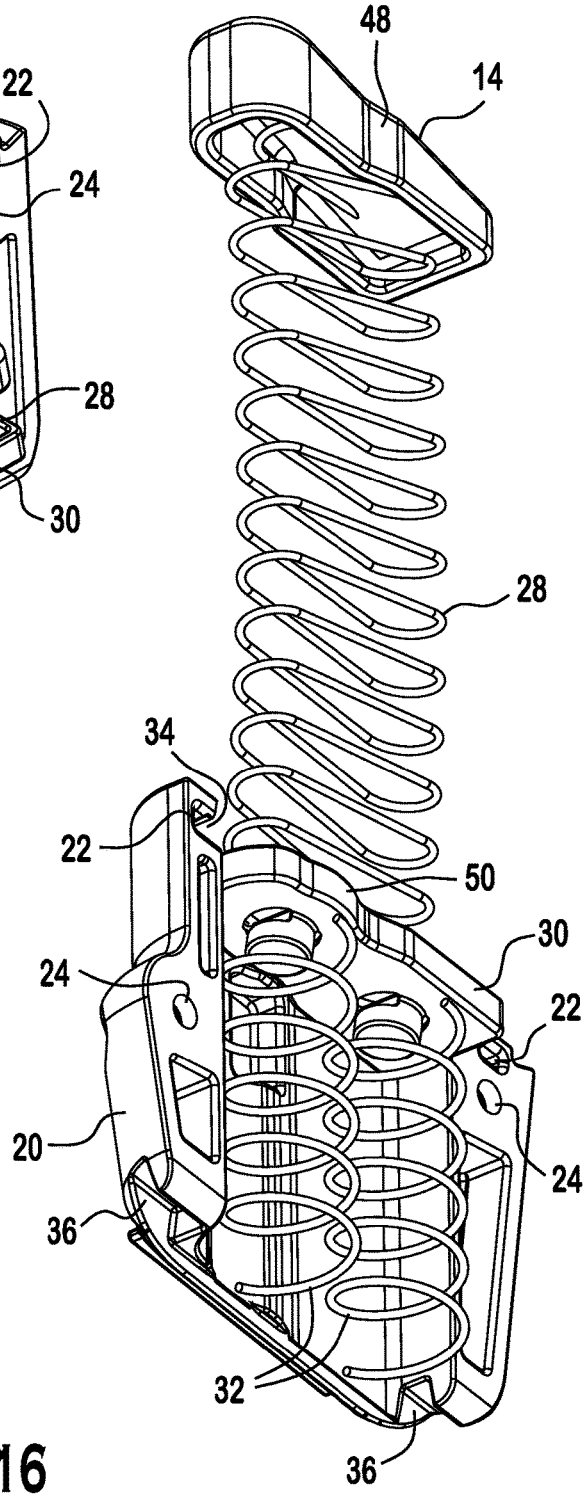
FIG. 16 is a lower, right, side view of ammunition magazine assembly of FIG. 14.
Figure 17:
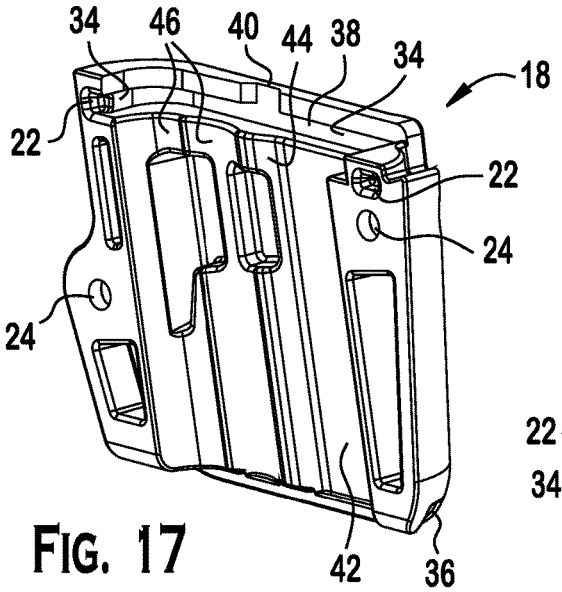
FIG. 17 is a perspective view of the starboard side piece of FIG. 14.
Figure 18:
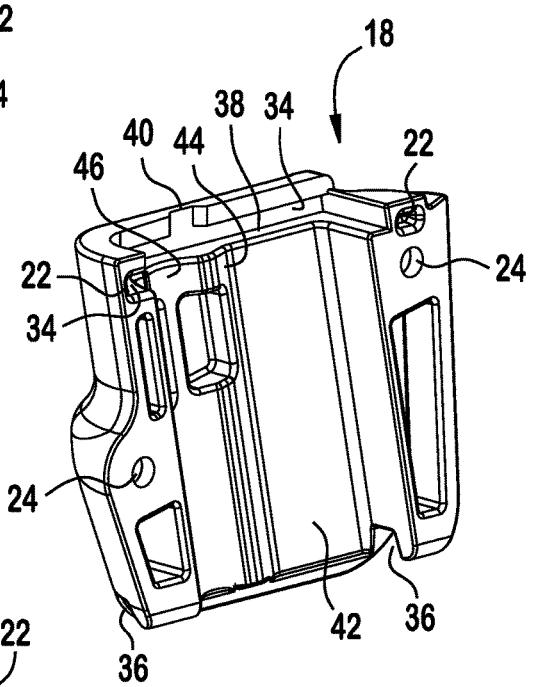
FIG. 18 is another perspective view of the starboard side piece of FIG. 14.
Figure 19:
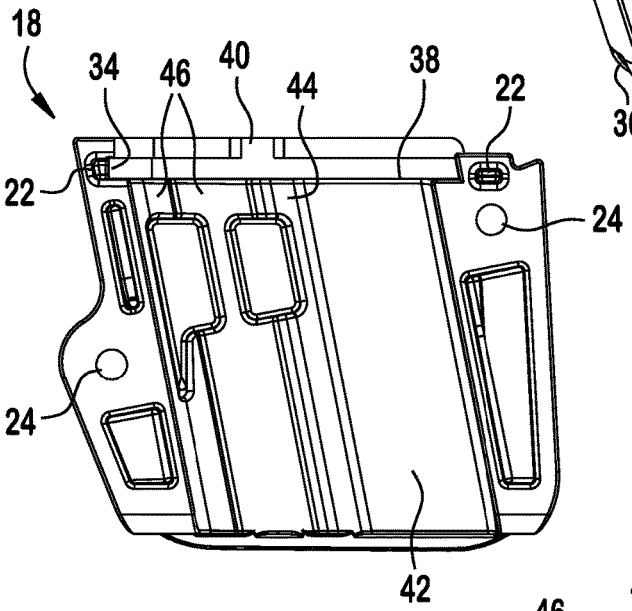
FIG. 19 is a right, side view of the starboard side piece of FIG. 14.
Figure 20:
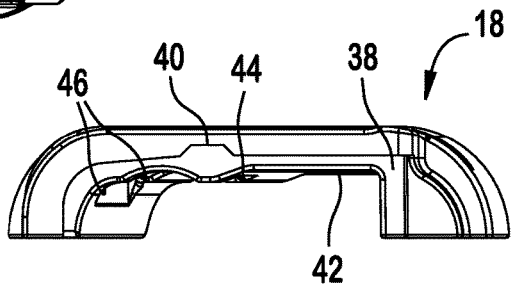
FIG. 20 is a top view of the starboard side piece of FIG. 14.
Figure 21:
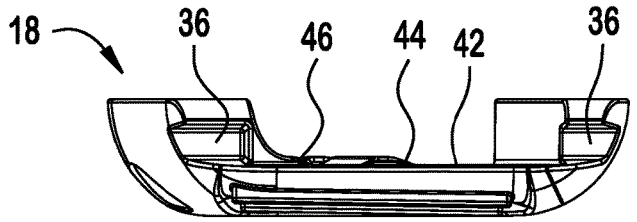
FIG. 21 is a bottom view of the starboard side piece of FIG. 14.
Figure 22:
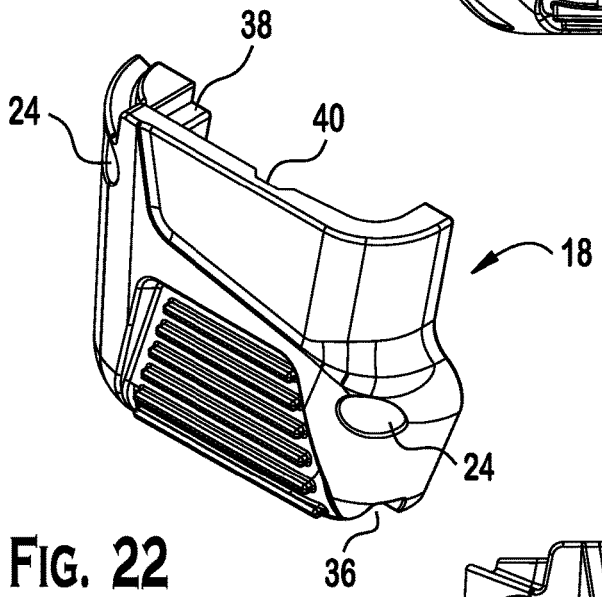
FIG. 22 is yet another perspective view of the starboard side piece of FIG. 14.
Figure 23:
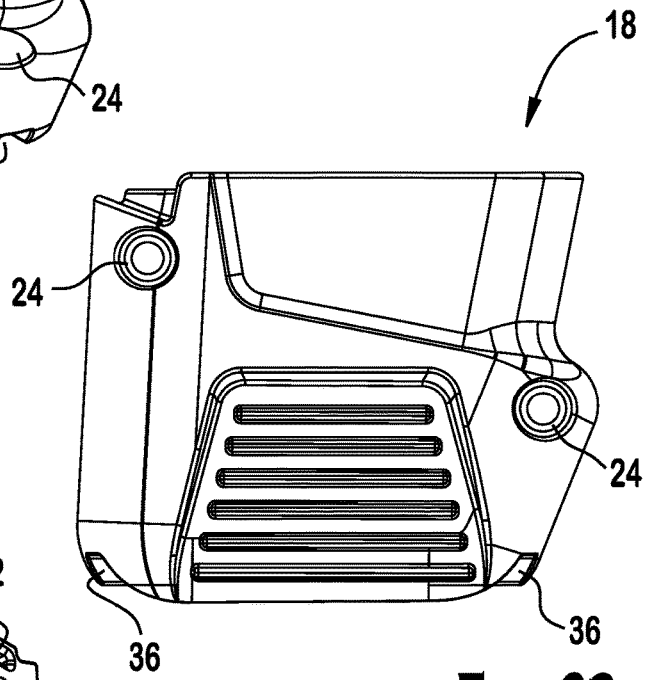
FIG. 23 is a left side view of the starboard side piece of FIG. 14.

Referring to FIG. 11, the base of the magazine may be connected to the magazine extension starboard side piece 18. Additionally, the magazine extension may house an ammunition cartridge follower 14, a magazine spring 28, a magazine extension follower 30, and two magazine extension springs 32. The ammunition cartridge follower 14 may be an original part of the magazine. Similarly, the magazine spring 28 may be an original part of the magazine. By contrast, the magazine extension follower 30 may be provided with the magazine extension 10, along with a pair of magazine extension springs 32. The cavity inside the magazine extension piece may be configured to provide additional ammunition capacity for the magazine housing 12. Referring to FIGS. 12 and 13, the magazine extension 10 may provide the ammunition magazine assembly 8 with two additional rounds of ammunition capacity as compared to the original factory magazine itself. In the fully loaded configuration the magazine spring 28 and the extension springs 32 each may be fully compressed. Other embodiments of the magazine extension may provide more (e.g., 4 additional cartridges) or less (e.g., 1 additional cartridge) of ammunition capacity and the springs 28, 32 need not be fully compressed when the magazine is loaded to full capacity with ammunition. As shown in FIGS. 12, 13, 15 and 26, the solid height of the magazine extension springs 32 may facilitate storage of one or more ammunition cartridges in the magazine extension 10.

Referring to FIG. 7 and FIG. 8, the magazine extension 10 may include a body 17 for storing firearm ammunition 16. The body 17 may include an upper end portion 19 which includes a seat 11 for part of a firearm 4. As shown in FIGS. 11-13, the upper end portion 19 further may include a magazine casing receiving groove 34. Also, the body 17 may include a lower end portion 21, and an exterior surface 23 extending from the upper end portion 19 to the lower end portion 21, as well as an opening 26 extending into the body. The body 17 may include a bench 56 inside the opening. A magazine extension follower 30 may be disposed above the bench 56. Referring to FIG. 11, the magazine extension follower 30 may include an upper surface 31, a lower surface 33, and a side wall 35. See also, FIGS. 38-40. As shown in FIG. 11, the magazine extension follower 30 may form an ammunition magazine spring bearing surface. The magazine extension 10 may include a resilient member 32 disposed between the magazine extension follower 30 and the bench 56 which biases the magazine extension follower 30 away from the lower end portion 21.

Referring to FIG. 11, when the magazine assembly 8 is in the fully unloaded configuration, the ammunition cartridge follower 14 projects out of the top end of the magazine housing 12, but the magazine extension follower 30 may remain inside the magazine extension 10. The magazine spring 28 and the magazine extension springs 32 are in an expanded but partially compressed configuration. Although the magazine extension springs 32 may be stiffer than the magazine spring 28, the magazine extension spring(s) 32 may have equal or lesser stiffness than the magazine spring. Also, the magazine extension spring(s) may be a flat spiral compression spring. For example, the flat spiral compression spring may be compressed to the thickness of a single coil to save space inside the magazine extension housing.

Referring to FIGS. 12 and 13, by contrast, when the magazine assembly 8 is in the fully loaded configuration, the magazine follower (or ammunition cartridge follower) 14, the magazine spring 28, the magazine extension follower 30 and the magazine extension springs 32 may be fully contained inside the magazine extension. Additionally, one or more full ammunition cartridge(s) may be positioned inside the magazine extension in the fully loaded configuration. For example, as shown in FIG. 12, one ammunition cartridge is positioned entirely inside the magazine extension 10. In another embodiment, two ammunition cartridges may be positioned entirely inside the magazine extension 10. In yet another embodiment, three ammunition cartridges may be positioned entirely inside the magazine extension. And in yet another embodiment, four ammunition cartridges may be positioned entirely inside the magazine extension. The height of the magazine extension may vary to accommodate additional ammunition cartridges. For instance, a magazine extension that is configured and dimensioned to augment a factory magazine by providing an additional four ammunition cartridges may have a greater height than another magazine extension that provides for two additional ammunition cartridges. Additionally, the magazine extension springs may be designed to provide an appropriately compact configuration when fully compressed. For instance, the magazine extension springs may be designed as conical springs which compress to a very short profile. Alternatively, the magazine extension springs may be designed as one or more flat springs, nested springs or flat wire compression springs (e.g., wave spring). Although, the magazine extension springs in FIGS. 12 and 13 are two identical compression springs, any suitable spring design may be used provided that the spring design provides sufficient force to reliably load the last ammunition cartridge into the pistol chamber from the ammunition magazine assembly.

Referring to FIGS. 11, 14, 16, 25 and 45, the magazine extension springs may be seated below the magazine extension follower 30. The factory magazine spring 28 may be positioned on top of the ammunition magazine follower 30. Although the factory magazine spring 28 may simply rest within the ammunition magazine follower 30 (as shown in FIGS. 14, 15, 25, and 26), in other embodiments the factory magazine spring 28 may be further attached or secured to the magazine extension follower 30.

Referring to FIG. 11 the magazine extension springs may be compressed from their respective free length when the ammunition magazine assembly is assembled and in the fully unloaded configuration. In this configuration, the magazine springs may provide a minimum level of spring force against the magazine extension follower 30. The minimum level of spring force may be equal to or greater than a reference level of spring force. In one embodiment, the reference level of spring force may be equal to the average spring force applied by the follower of the original factory magazine against the last ammunition cartridge stored in the magazine. This reference level of spring force may be determined by measuring the spring force applied by the follower of the original factory magazine to a sole (i.e., last) ammunition cartridge that is stored in the magazine.

Measurements for determining this spring force may be made using a dynometer. For instance, an analogue force gauge or a digital force gauge and sensor may be used. For example, a hand-held, analogue push gauge may be pressed against a sole (i.e., last) ammunition cartridge stored in an original factory magazine to measure the compressive force needed to press the ammunition cartridge into the magazine housing. Alternatively, a hand-held, analogue push gauge may be pressed against a sole (i.e., last) ammunition cartridge stored in an original factory magazine to measure the compressive force needed to press the ammunition cartridge into the magazine housing by a given distance (for example and without limitation, 5 mm, or the maximum outer diameter of the cartridge). This type of a measured level of force may be used to determine a reference level of force for the magazine extension spring design. Moreover, determination of the reference level of force may be based on a single measurement, an average of more than one measurement, a statistical analysis of measured data, other quantitative analyses, and/or empirical testing of the ammunition magazine assembly's operation. Further, the minimum level of spring force may include a factor of safety (e.g., 10%-15%) to ensure that the magazine extension springs will meet or exceed the reference level of spring force. Although the foregoing technique or variants thereof may be useful for establishing a minimum level of spring force, the spring design of the magazine extension may be accomplished by any suitable technique or analysis, provided that the ammunition magazine assembly functions reliably in service.

Figures 25, 26:
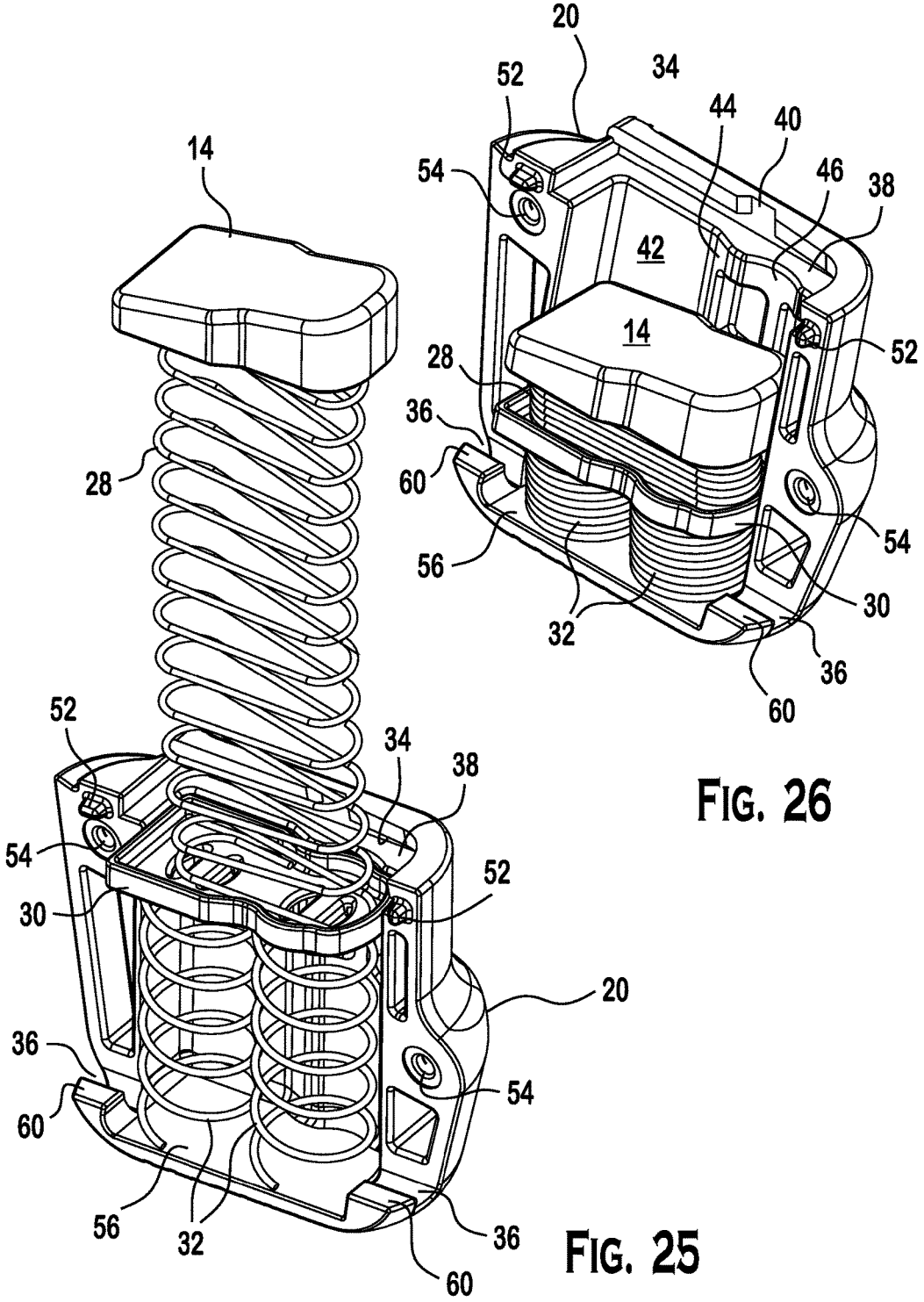
FIG. 25 is a perspective view of the ammunition magazine assembly of FIG. 3, without the magazine casing and the magazine extension starboard side piece.
FIG. 26 is a perspective view of the ammunition magazine assembly of FIG. 25, showing the magazine spring and magazine extension springs in a fully compressed configuration.
Figure 27:
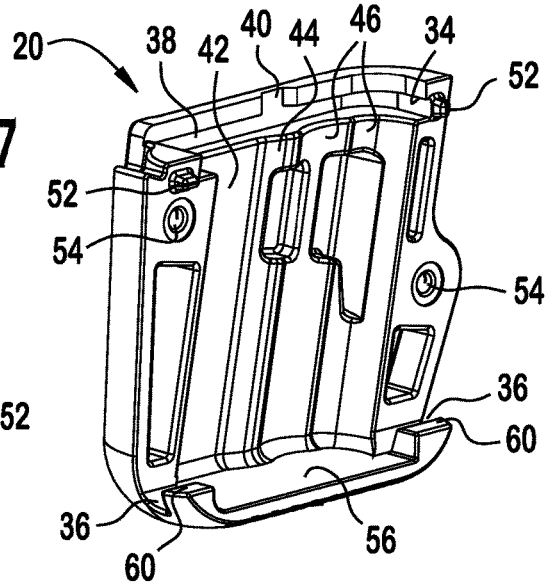
FIG. 27 is an upper rear perspective view of the port side piece of FIG. 25.
Figure 28:
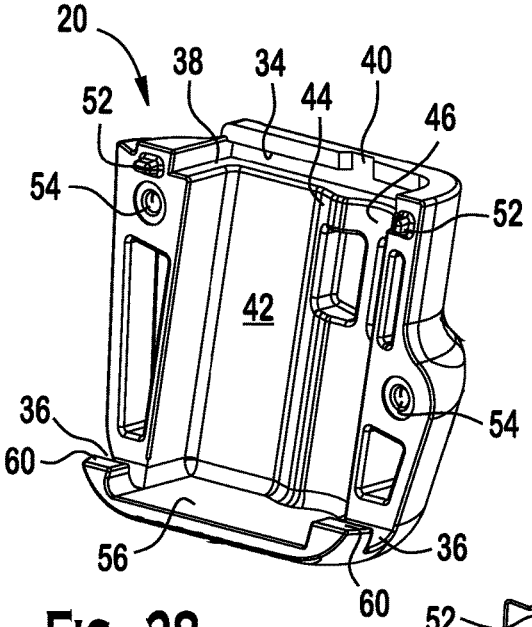
FIG. 28 is an upper front side perspective view of the port side piece of FIG. 25.
Figure 29:
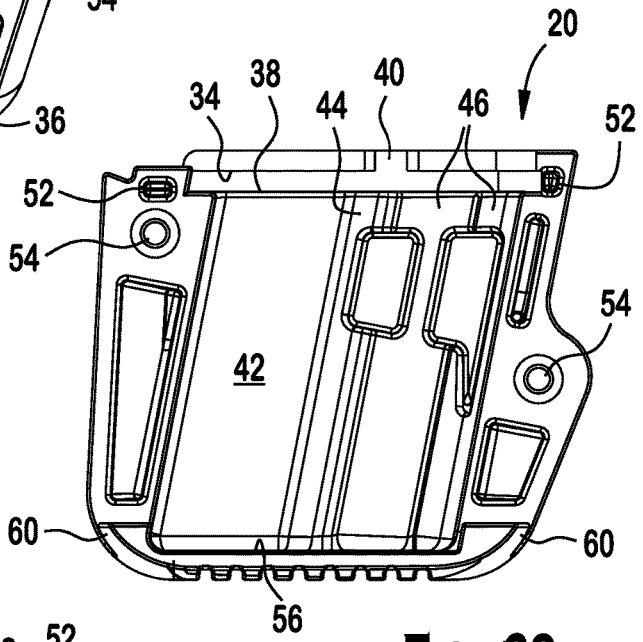
FIG. 29 is a left side view of the port side piece of FIG. 25.
Figure 30:
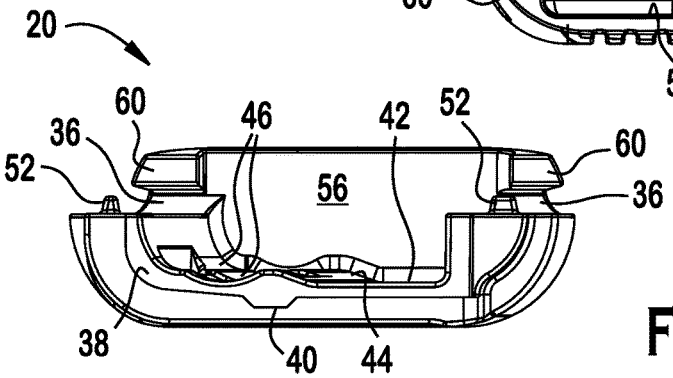
FIG. 30 is a top view of the port side piece of FIG. 25.
Figure 31:
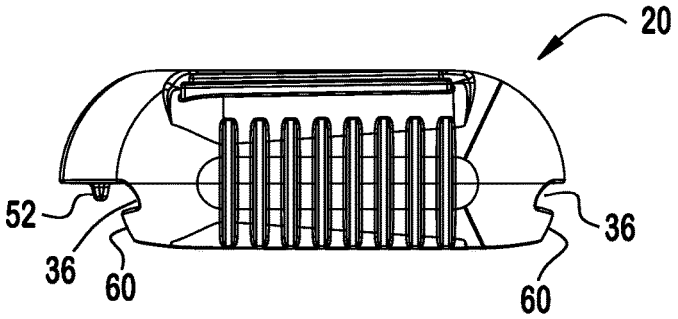
FIG. 31 is a bottom view of the port side piece of FIG. 25.
Figure 32:
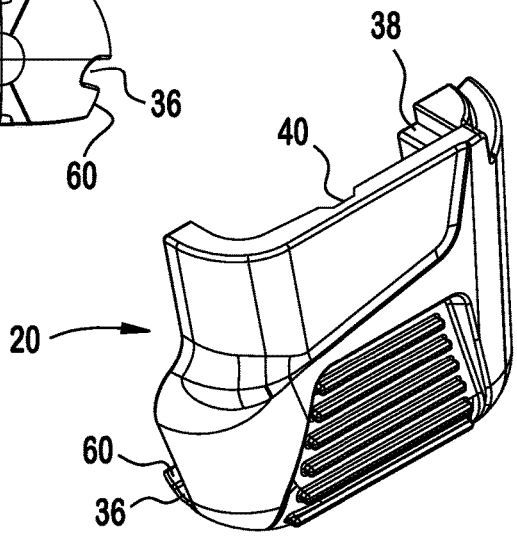
FIG. 32 is another upper front side view of the port side piece of FIG. 25.
Figure 33:
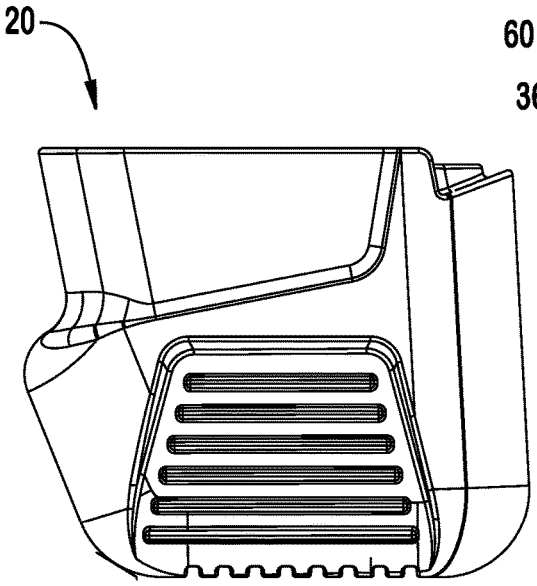
FIG. 33 is a right, side view of the port side piece of FIG. 25.
Figure 39:
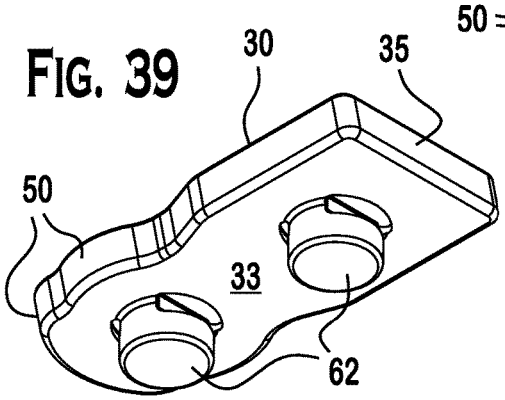
FIG. 39 is a lower rear perspective view of the magazine extension follower of FIG. 14.
Figure 38:
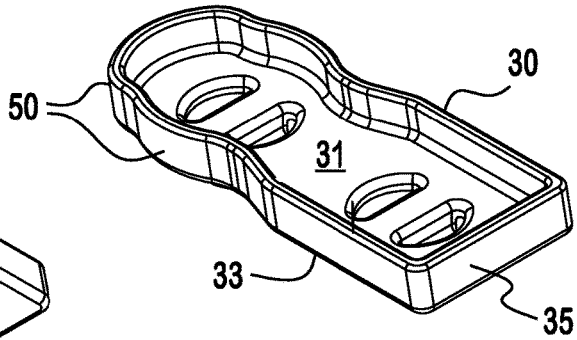
FIG. 38 is an upper rear perspective view of the magazine extension follower of FIG. 14.
Figure 40:
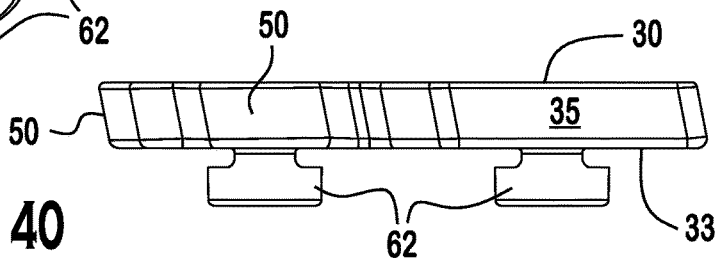
FIG. 40 is a right, side view of the magazine extension follower of FIG. 14.

Referring to FIGS. 25 and 26, the magazine spring may be seated directly on the upper surface of the magazine extension follower. Referring to FIGS. 38, 39 and 40, the upper surface of the magazine extension follower may include a raised side wall to contain the bottom of the magazine spring. The magazine extension follower may further include magazine extension follower guides 50. Referring to FIGS. 11, 12, 16, 39 and 40, the bottom of the magazine extension follower may include two projections or knobs 62. One projection or knob may be used to connect to or support each of the magazine extension springs.

Referring to FIGS. 17, 18, 19, 24, 27, 28, 29, and 45 each of the magazine side pieces 18, 20 may include opposing grooves 34 and a bearing surface 38 for receiving a rim that is located at the base of the magazine housing. As shown in FIGS. 11, 12, 13 and 45, each magazine casing rim receiving groove(s) and bearing surface may be configured and dimensioned to circumscribe or support part of the base of the magazine casing and to slidably receive the rim in a snug or secure fit. As shown in FIGS. 13, 14, 15, 17, 18, 19, 20, 22, 24, 26, 27, 28, 29, 30, 32 and 34, the side wall adjacent the magazine rim bearing surface 38 may include a notch 40 which is configured and dimensioned to accommodate a projection on the rim of the magazine housing. In this manner, the magazine housing may be seated firmly in the magazine extension side pieces and fixed with respect to those parts when the magazine extension side pieces are locked together with one or more fasteners.

Figure 24:
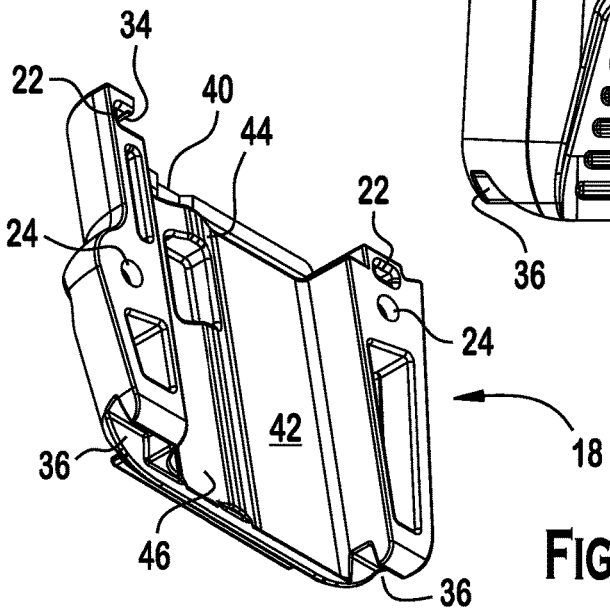
FIG. 24 is a lower front perspective view of the starboard side piece of FIG. 14.
Figure 34:
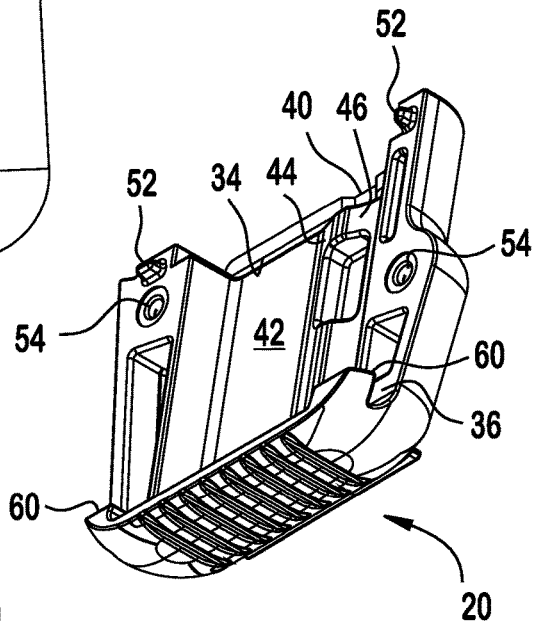
FIG. 34 is a lower front perspective view of the port side piece of FIG. 25.
Figure 36:
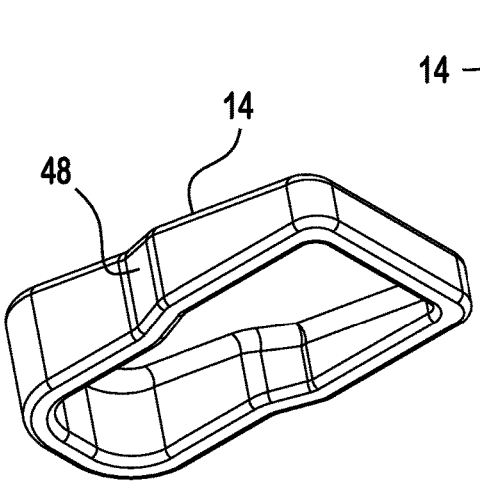
FIG. 36 is a lower rear perspective view of the illustrative follower of FIG. 14.
Figure 35:
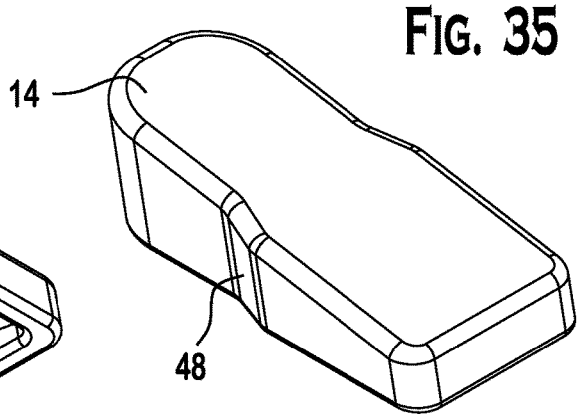
FIG. 35 is an upper rear perspective view of the illustrative follower of FIG. 14.
Figure 37:
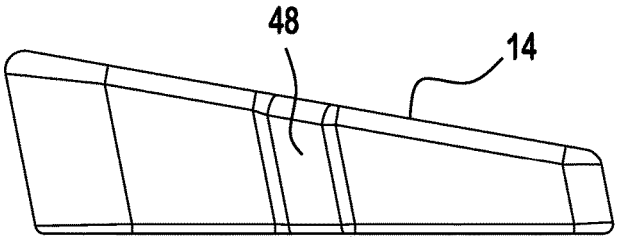
FIG. 37 is a right, side view of the illustrative follower of FIG. 14.

Referring to FIGS. 17, 18, 19, 20, 21, 24, 26, 27, 28, 29, 30 and 34, the interior side wall 42 of the side pieces 18, 20 may include features 44, 46 which may promote the travel and feeding of ammunition from within the magazine extension to the pistol chamber. For example, the interior surface may include rounded smooth surfaces that may contact and guide the ammunition follower, magazine extension follower, or ammunition cartridges as the magazine spring and magazine extension springs expand to deliver ammunition from within the magazine assembly to the top of the magazine housing. Referring to FIGS. 24 and 34 the interior side wall 42 may include a magazine follower guide surface 44 which may interact with a guide on the magazine follower. Also, the interior side wall 42 of the side pieces may include opposing structures 22, 52 which mate when the side pieces are placed together to prevent rotational movement between the pieces and maintain an appropriate alignment between the internal features of the side pieces.

Referring to FIGS. 25, 26, 44, 45 and 46, the magazine extension springs may be placed directly in contact with a floor of one of the pieces. For example, the port side piece may include a bench 56 that forms the bottom wall of the magazine extension spring housing. Other configurations, however, also may be used.

Referring to FIGS. 21, 22, 23, 24, 44, the bottom of the starboard side piece 18 may include a hook receiving slot 36. The hook receiving slot may be a recess on a lower surface of the starboard side piece that is configured and dimensioned to mate with a complimentary shaped projection or hook 60 (see FIGS. 25, 26, 30, 34, 46) on the port side piece 20.

Referring to FIGS. 5, 7, 9, 44 and 46, the starboard side piece 18 and the port side piece 20 may interlock and mate to form an ammunition magazine assembly that includes a magazine grip extension. The magazine grip extension pieces may be formed from one or more materials (e.g. metal, metal alloys, wood, plastic, polymer materials, reinforced polymer materials, thermoplastic materials, and combinations thereof).

Referring to FIGS. 4, 5, 7, 9, 10, 11, 12, 14, the starboard side piece 18 may include an aperture 24, which extends from the outer surface of the piece to an interior of the piece. Each aperture may be a countersunk opening for receiving a fastener. The fastener 72 (FIGS. 11, 12, 42, 44, 46) may mate with an opposing opening 54 on the port side piece 20 (see e.g., FIGS. 28, 24, 42, and 44).

As described above, the magazine grip extension may improve the grip of the pistol for some users, as well as provide additional ammunition capacity for the magazine. As shown in FIGS. 6, 7, 8, 9, 10, 22, 23, 31, 32, 33, 34, the exterior surfaces of the starboard side piece 18 and the port side piece 20 may include features 13 and texture 15 to enhance a user's ability to hold and manipulate the magazine extension. The features and texture may form an ergonomic shaped gripping surface.

In the exemplary embodiment, an eight-round capacity ammunition magazine in conjunction with the disclosed magazine extension may provide an ammunition magazine assembly with an enhanced gripping surface and a ten-round capacity. Thus, the ammunition magazine assembly of FIG. 1 may provide enhanced user comfort and control, as well as 24% more ammunition capacity than the magazine by itself. In another exemplary embodiment, a six-round capacity magazine in conjunction with a magazine extension in accordance with the present disclosure may provide an ammunition magazine assembly with enhanced gripping surface and a ten-round capacity. Preferably, the magazine assembly may use an original factory magazine housing, spring and follower. However, other magazine springs and or components may be provided with the magazine extension to modify the performance and reliability of the ammunition magazine assembly.

Figure 41:
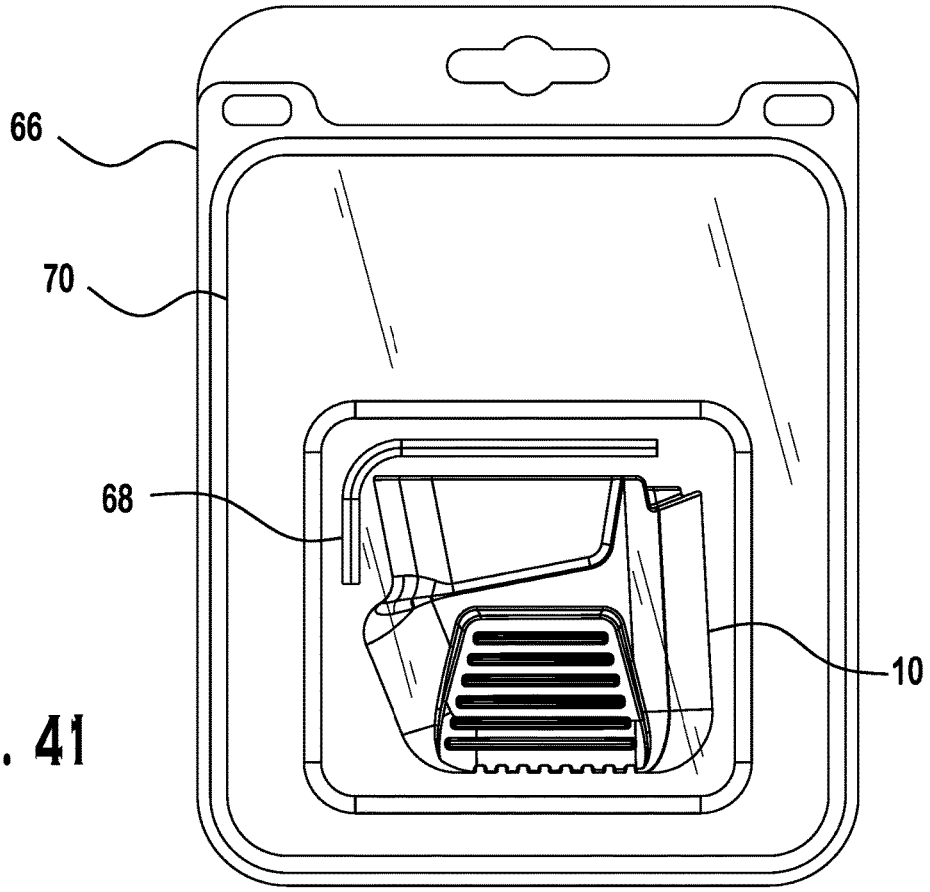
FIG. 41 is a plan view of an exemplary kit for the exemplary magazine extension of FIG. 1.
Figure 42:
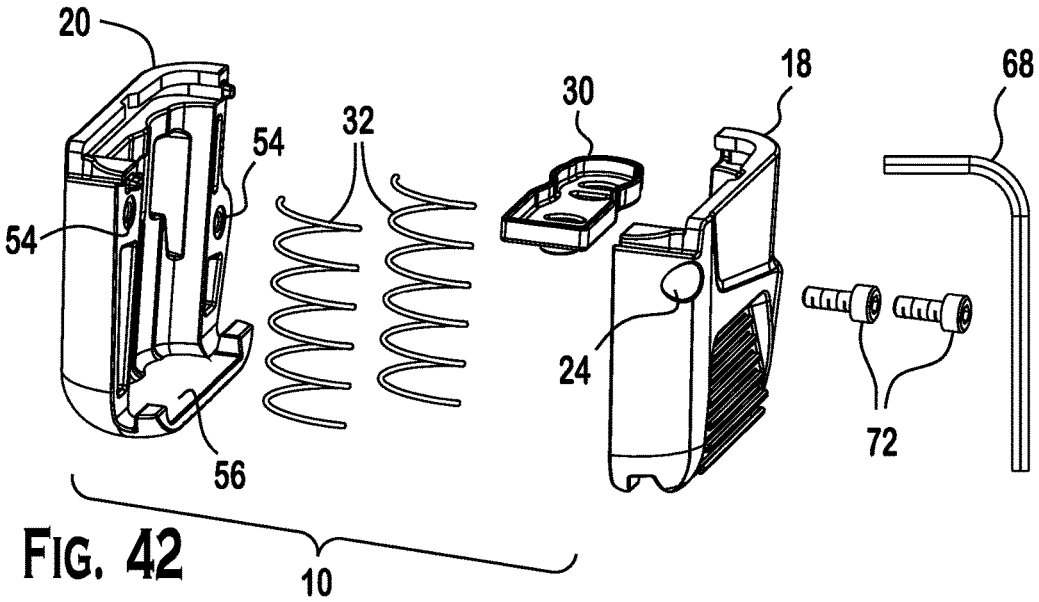
FIG. 42 is an exploded view of the mechanical kit components of FIG. 41.

FIG. 41 shows a kit 64 for upgrading an original factory magazine 7 (FIG. 43) in to an ammunition magazine assembly with enhanced ammunition storage capacity. The kit 64 may include a clear plastic pack 64 that contains a magazine extension 10, a tool 68, and installation instructions. As shown in FIG. 42, the mechanical components of the kit may include a starboard side piece 18, a port side piece 20, two magazine extension springs 32, a magazine extension follower 30, two fasteners (e.g., hex screws) 72, and a tool (e.g., an Allen wrench).

Figure 43:
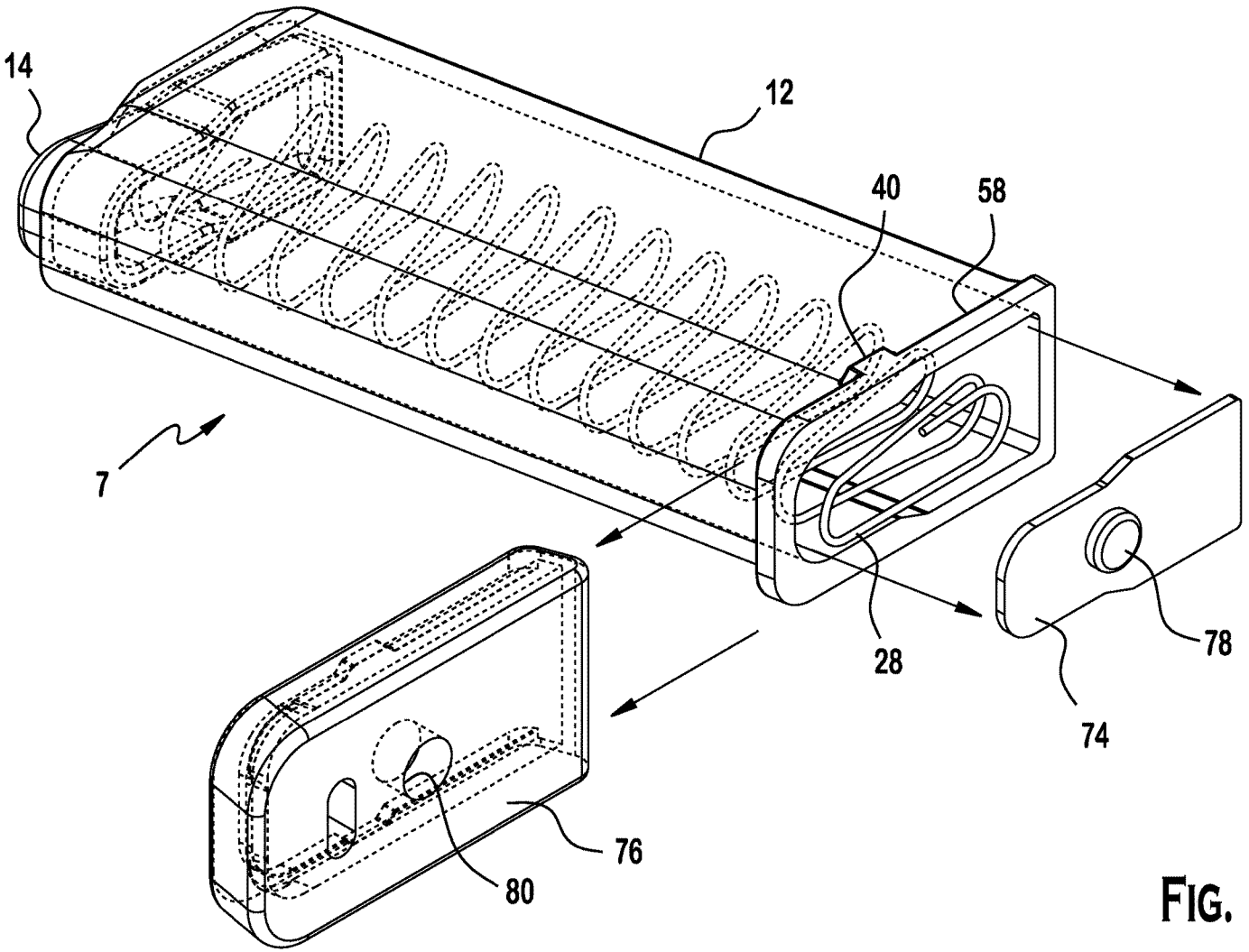
FIG. 43 shows an exemplary ammunition magazine for a pistol.

Referring to FIG. 43, an original factory magazine 7 may include a magazine housing 12, a follower 14, a magazine spring 28, a locking plate 74 and a floor plate 76. The magazine housing 12 may include a magazine rim 58 at the housing base. In normal use, the locking plate may be placed in contact with the magazine spring 28 and pressed into the housing 12. The floor plate 80 may then be slid on the magazine rim 58 to cover the opening at the base of the magazine housing 12 to capture the locking insert 74 and magazine spring 28. A locking plate pin 78 may press into a receiving hole 80 in the floor plate 76 to fix the floor plate to the housing 12. By contrast, the original factory magazine 7 may be disassembled by pressing the locking pin 78 inward from the base of the floor plate 76 to separate the magazine insert from the floorplate 76. After releasing the floor plate from the magazine insert the floor plate 76 may be slid off the magazine rim 58 and separated from the housing 12.

Figure 44:
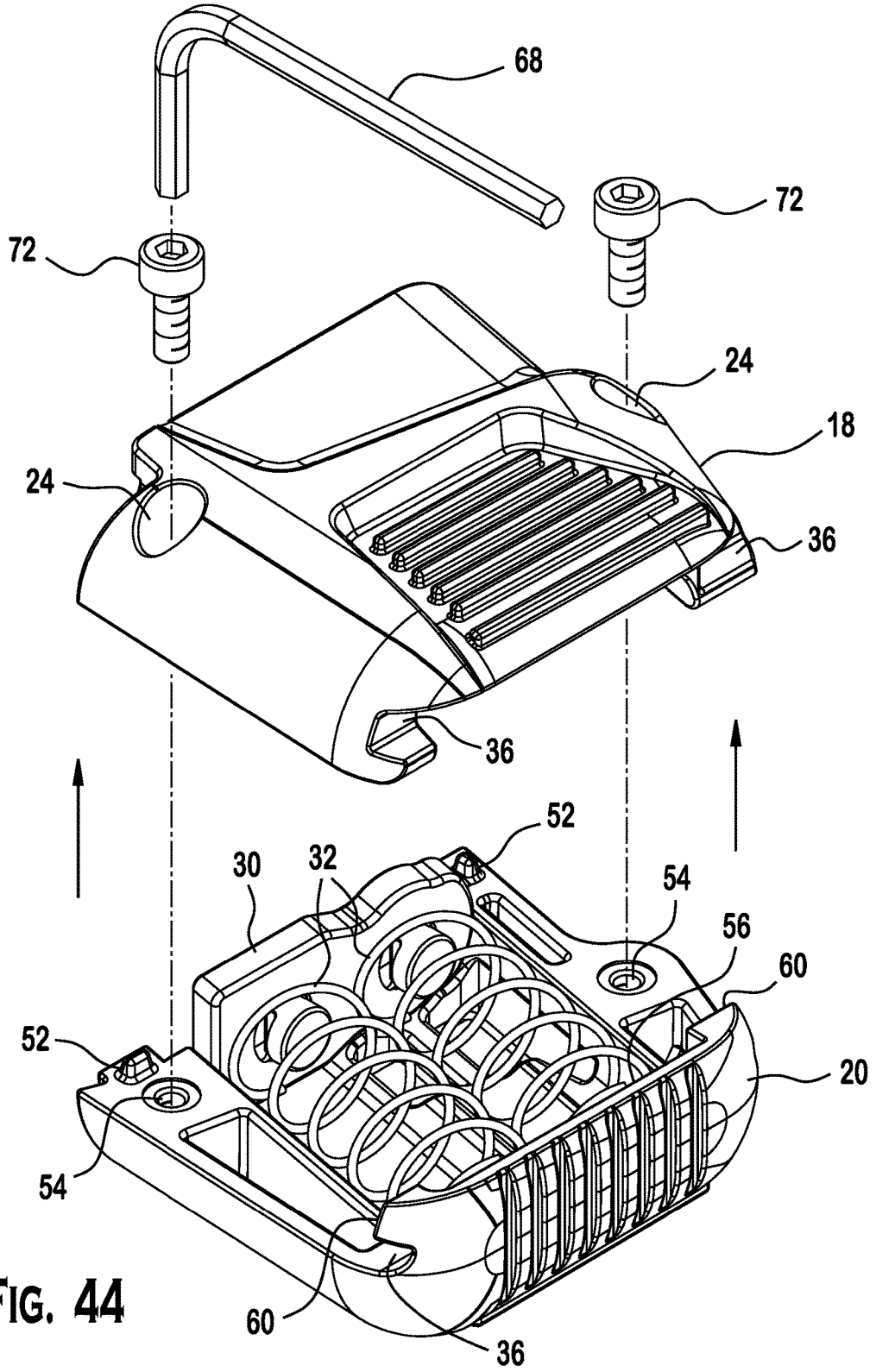
FIG. 44 shows a disassembled magazine extension of FIG. 41.

Referring to FIG. 44, the fasteners 72 of the magazine extension 10 may be unfastened and removed using the tool provided in the kit. The starboard side piece 18 may then be separated from the portside piece. The port side piece may contain the magazine extension follower 30 and magazine extension springs 32.

Figure 45:
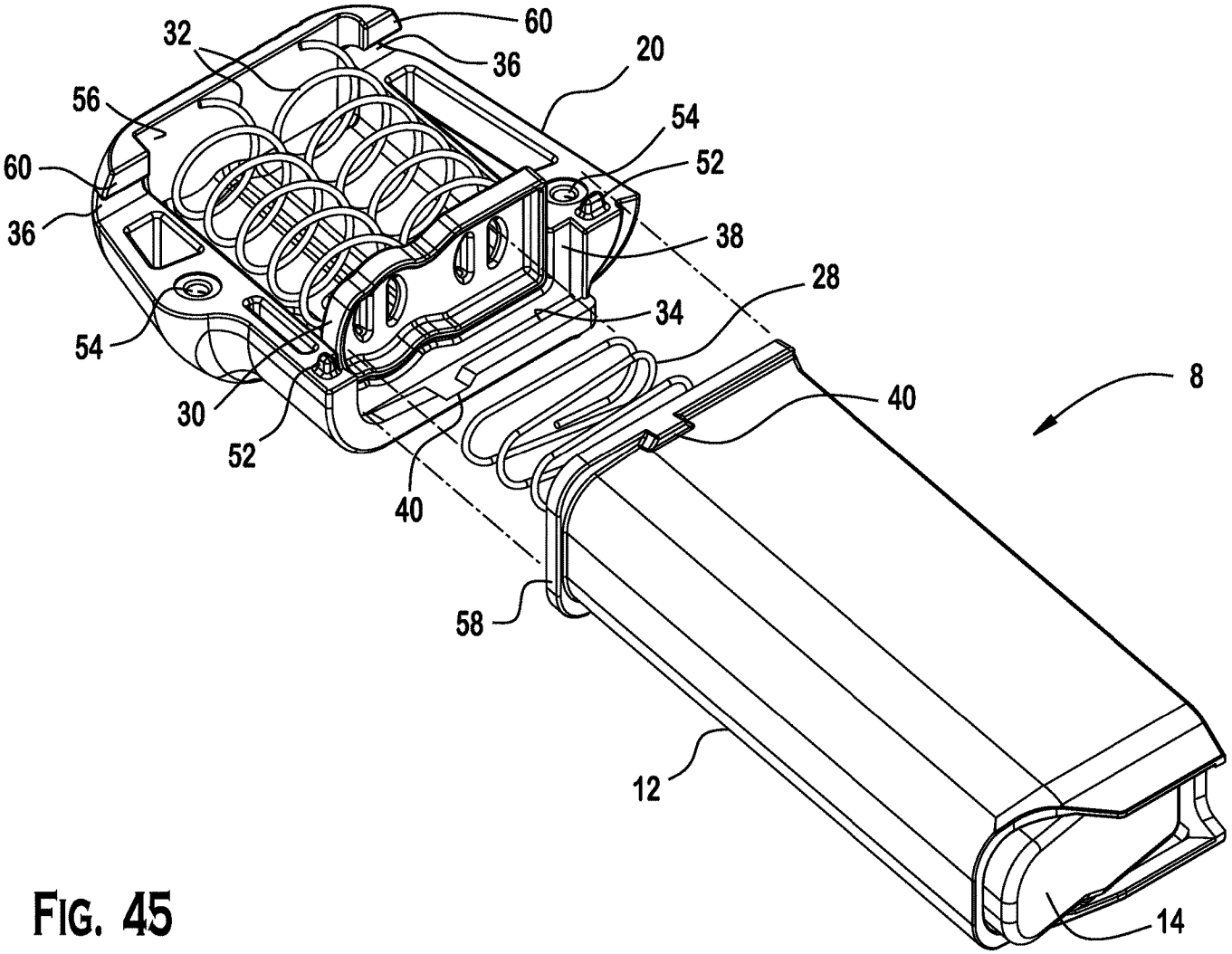
FIG. 45 shows the port side piece of the magazine extension of FIG. 41 receiving a portion of the disassembled ammunition magazine of FIG. 43.

Referring to FIG. 45, the original factory magazine housing 12, follower 14 and magazine spring 28 may then be secured to the port side piece 20. More particularly, the magazine spring 28 may be placed into the magazine extension follower 30 and the rim 58 of the magazine housing may be disposed on magazine rim bearing surface 38 and inserted into the magazine casing rim receiving groove 34.

Figure 46:
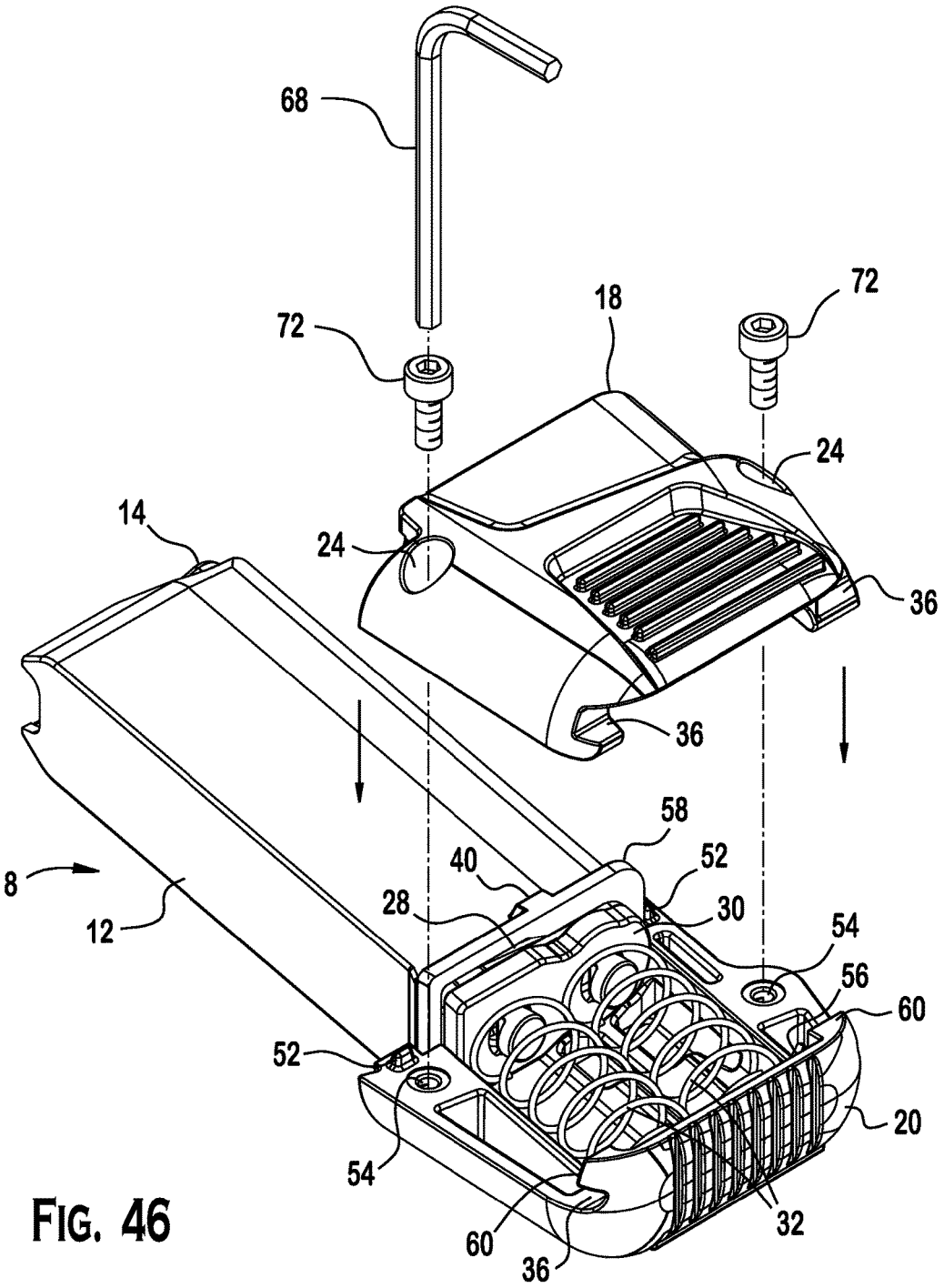
FIG. 46 shows the starboard side piece of the magazine extension being secured to the port side piece of the magazine extension and the ammunition magazine portion of FIG. 45 to form the ammunition magazine assembly of FIG. 1.

Referring to FIG. 46, the starboard side piece 18 may then be fitted over the magazine casing rim 58 and the port side piece 20. After the magazine housing 12, starboard side piece 18, and port side piece 20 are securely mated, the fasteners 72 may be advanced through respective guide holes 24, 54 in the starboard side piece 18 and port side piece 20, respectively, to fix the magazine extension to the magazine housing 12. In this manner, an original factory magazine may be modified to store and feed addition ammunition rounds, as well as provide a larger grip for a pistol during use. The larger grip may include an ergonomic shaped gripping surface for enhanced gun control.

Although the disclosed embodiment of the magazine extension is directed toward an ammunition magazine assembly for a pistol, it is envisioned that a magazine extension may be developed for other types of ammunition magazines (e.g., box magazines for rifles) such that various ammunition magazine assemblies may be developed based on this disclosure for other firearms including, without limitation, rifles, carbines, and other guns.

In use, an operator may unload an empty magazine from a firearm, such as a pistol, and then remove the base plate and or floor plate of the magazine. Then, after properly orienting the magazine casing with respect to the port side piece of the magazine extension, the magazine spring may be set on the upper surface of the magazine extension follower. Each knob on the lower side of the magazine extension follower may be connected to a magazine extension spring. The bottom ends of the magazine extension springs may be placed against the bench of the properly oriented port side piece. The magazine casing then may be slid into the magazine casing rim receiving groove and seated onto the magazine rim bearing surface of the port side piece. The starboard side piece then may be mated to the port side piece and the magazine casing to enclose the internal components of the ammunition magazine assembly and fix the relative positions of the outer assembly components. A screw then may be inserted into each of the fastener receiver openings on the exterior surface of the starboard side piece. The fasteners may each be advanced into the corresponding fastener receiving opening in the port side piece to draw the two pieces together. In this manner, the two pieces and magazine casing may be fixedly secured to prevent relative movement and to form a unitary structure for the ammunition magazine assembly. The ammunition magazine assembly may then be loaded with ammunition and used with the pistol to provide a user with an enhanced grip and storage capacity for two additional rounds of ammunition.

Hence, the present disclosure is directed toward a magazine extension that may increase the ammunition capacity of a firearm ammunition magazine. For instance, as shown in FIG. 12, a magazine extension 10 may be configured for an ammunition magazine that includes a housing 12 with a rim 58. The magazine extension 10 may include a body 17 for storing firearm ammunition 16. The body may include an upper end portion 19. The upper end portion 19 may include a seat 11 configured to receive a portion of a firearm, a magazine casing bearing surface 38 spaced from the seat, the magazine casing bearing surface being substantially flat. The upper end portion 19 further may include a magazine casing receiving groove 34 proximate the magazine casing bearing surface 38, the magazine casing receiving groove 34 and the magazine casing bearing surface 38 being configured and dimensioned to slidably receive a rim 58 of an ammunition magazine housing 12. The body 17 may further include a lower end portion 21 spaced from the upper end portion 19, an exterior surface 23 extending from the upper end portion 19 to the lower end portion 21, and an opening 26 extending into the body 17 from the upper end portion 19 toward the lower end portion 21. See e.g., FIG. 25 and FIG. 26. Also, the body 17 may include a bench 56 inside the opening 26 disposed between the upper end portion 19 and the lower end portion 21 such that the opening 26 terminates at the bench 56. As shown in FIG. 38, the magazine extension 10 further may include a magazine extension follower 30 disposed above the bench 56. The magazine extension follower 30 may include an upper surface 31, a lower surface 33, and a side wall 35 around the upper surface. The side wall 35 and the upper surface 31 may form a cup 37 that is configured and dimensioned to form an ammunition magazine spring bearing surface. See e.g., FIGS. 14 and 25. Referring to FIG. 11, the magazine extension 10 further may include a resilient member 32 disposed in the opening 26 proximate to the lower surface 33 of the magazine extension follower and the bench 56 such that the resilient member 32 biases the magazine extension follower 30 away from the lower end portion 21.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, the shape, materials of construction, and spring force of the magazine extension springs may be adapted for use with a particular magazine geometry, ammunition capacity or style of ammunition cartridge. Additionally, features and or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A magazine extension configured for an ammunition magazine that includes a housing with a rim comprising:
- a body for storing firearm ammunition, the body comprising
  - an upper end portion which comprises
    - a seat configured to receive a portion of a firearm,
    - a magazine casing bearing surface spaced from the seat, the magazine casing bearing surface being substantially flat, and
    - a magazine casing receiving groove proximate the magazine casing bearing surface, the magazine casing receiving groove and the magazine casing bearing surface being configured and dimensioned to slidably receive a rim of an ammunition magazine housing,
  - a lower end portion spaced from the upper end portion,
  - an exterior surface extending from the upper end portion to the lower end portion,
  - an opening extending into the body from the upper end portion toward the lower end portion, and
  - a bench inside the opening, the bench being disposed between the upper end portion and the lower end portion such that the opening terminates at the bench;
- a magazine extension follower disposed above the bench, the magazine extension follower comprising
  - an upper surface,
  - a lower surface, and
  - a side wall around the upper surface, the side wall and the upper surface forming a cup that is configured and dimensioned to form an ammunition magazine spring bearing surface; and
- a resilient member disposed in the opening, the resilient member being proximate to the lower surface of the magazine extension follower and the bench such that the resilient member biases the magazine extension follower away from the lower end portion.

2. The magazine extension of claim 1, wherein the resilient member comprises at least one spring.

3. The magazine extension of claim 2, wherein the at least one spring comprises two springs.

4. The magazine extension of claim 3, wherein the two springs are substantially the same.

5. The magazine extension of claim 4, wherein the two springs are coil springs.

6. The magazine extension of claim 4, wherein the two springs are adjacent to one another.

7. The magazine extension of claim 1, wherein the at least one spring is a flat spring.

8. The magazine extension of claim 7, wherein the flat spring is a spiral compression spring.

9. The magazine extension of claim 2, wherein the at least one spring is designed to provide a minimum level of spring force against the magazine extension follower when the magazine extension follower is positioned within the opening.

10. The magazine extension of claim 9, wherein the minimum level of spring force is based on a measure of compressive force needed to depress a sole remaining ammunition cartridge stored in an ammunition magazine.

11. The magazine extension of claim 10, wherein the minimum level of spring force is based on an average of a series of measurements of compressive force needed to depress a sole remaining ammunition cartridge stored in an ammunition magazine.

12. The magazine extension of claim 10, wherein the minimum level of spring force is substantially equal to an average of a series of measurements of compressive force needed to depress a sole remaining ammunition cartridge stored in an ammunition magazine.

13. The magazine extension of claim 1, wherein the body is separable into pieces.

14. The magazine extension of claim 13, wherein the body is separable into a starboard side piece and a port side piece.

15. The magazine extension of claim 14, wherein the port side piece comprises a hook, and the starboard side piece comprises a hook receiving slot, the hook and the hook receiving slot being configured and dimensioned to interlock.

16. The magazine extension of claim 14, wherein the bench is part of the port side piece.

17. The magazine extension of claim 1, wherein the exterior surface is configured and dimensioned to complement a pistol grip.

18. An ammunition magazine assembly comprising:
- a magazine extension of claim 1;
- an ammunition magazine housing which comprises a rim, the rim being disposed in the magazine casing receiving groove;
- an ammunition magazine follower in the ammunition magazine housing; and
- a magazine spring disposed between the follower and the upper surface of the magazine extension follower.

19. A method of increasing the capacity of an ammunition magazine comprising:
- providing an ammunition magazine which comprises
  - an ammunition magazine housing which comprises a rim,
  - an ammunition magazine follower, and
  - an ammunition magazine spring;
- providing a magazine extension of claim 1;
- inserting the ammunition spring into the cup of the magazine extension follower; and
- inserting the rim into the magazine casing receiving groove.

20. The magazine extension of claim 1, wherein the resilient member provides a minimum level of spring force against the magazine extension follower when the magazine extension follower is positioned within the opening, the minimum level of spring force being equal to or greater than a reference level of spring force.

* * * * *